US008662487B2

(12) United States Patent
Watanabe et al.

(10) Patent No.: US 8,662,487 B2
(45) Date of Patent: Mar. 4, 2014

(54) SHEET PROCESSING APPARATUS, IMAGE FORMING APPARATUS, AND IMAGE FORMING SYSTEM

(71) Applicant: Canon Kabushiki Kaisha, Tokyo (JP)

(72) Inventors: Naoto Watanabe, Abiko (JP); Manabu Yamauchi, Kashiwa (JP); Takayuki Fujii, Tokyo (JP); Shunsuke Nishimura, Tokyo (JP); Yushi Oka, Abiko (JP); Toshiyuki Miyake, Abiko (JP); Takashi Yokoya, Kashiwa (JP); Hidenori Matsumoto, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/956,526

(22) Filed: Aug. 1, 2013

(65) Prior Publication Data

US 2013/0324387 A1 Dec. 5, 2013

Related U.S. Application Data

(62) Division of application No. 12/744,170, filed as application No. PCT/JP2008/003609 on Dec. 4, 2008.

(30) Foreign Application Priority Data

Dec. 7, 2007 (JP) ..... 2007-316917
Dec. 2, 2008 (JP) ..... 2008-307060

(51) Int. Cl.
*B65H 45/12* (2006.01)
*B31F 1/00* (2006.01)

(52) U.S. Cl.
USPC ..... 270/58.07; 270/32; 270/37; 270/45

(58) Field of Classification Search
USPC ..... 270/32, 37, 45, 51, 58.07; 412/16, 22, 412/26; 493/406, 407, 442, 454
See application file for complete search history.

(56) References Cited

U.S. PATENT DOCUMENTS

| | | | |
|---|---|---|---|
| 7,021,616 | B2 | 4/2006 | Mizuta et al. |
| 7,134,370 | B2 | 11/2006 | Murata et al. |
| 7,261,507 | B2 | 8/2007 | Horii et al. |
| 7,325,799 | B2 | 2/2008 | Watkiss |
| 7,331,573 | B2 | 2/2008 | Mizuta et al. |
| 7,354,233 | B2 | 4/2008 | Oki et al. |

(Continued)

FOREIGN PATENT DOCUMENTS

| | | |
|---|---|---|
| EP | 1331105 A2 | 7/2003 |
| EP | 1531060 A2 | 5/2005 |

(Continued)

OTHER PUBLICATIONS

U.S. Appl. No. 12/797,205, filed Jun. 9, 2010. Applicants: Manabu Yamauchi et al.

(Continued)

*Primary Examiner* — Leslie A Nicholson, III
(74) *Attorney, Agent, or Firm* — Fitzpatrick, Cella, Harper & Scinto

(57) ABSTRACT

A sheet processing apparatus which has a flattening processing unit which presses a folded end of a folded booklet bundle to flatten the folded end, and cutting units which cut and align edges of the booklet bundle, wherein the edges crossing the folded end of the booklet bundle are cut by the cutting unit and the folded end of the booklet is then flattened by the flattening processing unit.

9 Claims, 32 Drawing Sheets

(56) References Cited

U.S. PATENT DOCUMENTS

| | | | |
|---|---|---|---|
| 7,631,858 | B2 | 12/2009 | Harada |
| 7,891,928 | B2 | 2/2011 | Harada |
| 8,027,630 | B2 | 9/2011 | Fujii et al. |
| 2005/0100429 | A1 | 5/2005 | Oki et al. |
| 2007/0057446 | A1 | 3/2007 | Nishimura et al. |
| 2007/0081876 | A1 | 4/2007 | Harada |
| 2007/0120310 | A1 | 5/2007 | Awano |
| 2008/0122156 | A1 | 5/2008 | Fujii et al. |
| 2009/0055012 | A1 | 2/2009 | Toda et al. |
| 2009/0103962 | A1 | 4/2009 | Fujii et al. |

FOREIGN PATENT DOCUMENTS

| | | | |
|---|---|---|---|
| EP | 1531060 | A3 | 9/2006 |
| EP | 1790493 | A2 | 5/2007 |
| EP | 1795366 | A2 | 6/2007 |
| EP | 1876125 | A2 | 1/2008 |
| EP | 1531060 | B1 | 2/2008 |
| EP | 1790493 | A3 | 4/2010 |
| JP | 4-371895 | A | 12/1992 |
| JP | 2005-144766 | A | 6/2005 |
| JP | 2005-153075 | A | 6/2005 |
| JP | 2005-263404 | A | 9/2005 |
| JP | 2006-290588 | A | 10/2006 |
| JP | 2007-147815 | A | 6/2007 |
| JP | 2007-245650 | A | 9/2007 |
| JP | 4289456 | B2 | 7/2009 |
| JP | 4923538 | B2 | 4/2012 |

OTHER PUBLICATIONS

U.S. Appl. No. 12/829,734, filed Jul. 2, 2010. Applicants: Naoto Watanabe et al.

Supplemental European Search Report dated Feb. 24, 2011, in counterpart European Application No. 08856226.9-1256/2229330.

SHEET PROCESSING APPARATUS, IMAGE FORMING APPARATUS, AND IMAGE FORMING SYSTEM

This is a divisional of U.S. patent application Ser. No. 12/744,170, filed May 21, 2010, which is a National Stage Entry of International Application No. PCT/JP2008/003609, filed Dec. 4, 2008.

TECHNICAL FIELD

The present invention relates to a sheet processing apparatus which subjects a folded booklet bundle to a predetermined process, an image forming apparatus which has a processing function of the sheet processing apparatus, and an image forming system which has the sheet processing apparatus.

DESCRIPTION OF RELATED ART

Background Art

To process a sheet output from an image forming apparatus body, there has been known a sheet processing apparatus which folds a sheet bundle at its center in two (hereinafter, called the folding process) to make a folded booklet bundle (including a saddle-stitched booklet).

To improve the quality of the folded booklet bundle, there has been proposed a sheet processing apparatus which flattens a folded end (a back of the folded booklet bundle; a spine on the binding side) of the folded booklet bundle (hereinafter, called the flattening process, is one of deforming processes) (see Patent Citation 1 and Patent Citation 2).

To improve the quality of the folded booklet bundle, there has been known a sheet processing apparatus which cuts a fore edge (on the opening side) of the folded booklet bundle (hereinafter, called the fore edge cutting process) to make the folded booklet bundle whose fore edge has been aligned.

[Patent Citation 1]

U.S. Pat. No. 7,325,799

[Patent Citation 2]

Japanese Patent Application Laid-Open (JP-A) No. 2006-290588

DISCLOSURE OF INVENTION

Technical Problem

To improve the quality of the folded booklet bundle, it is considered that after the fore edge of the folded booklet bundle is cut and aligned, the folded booklet bundle is flattened.

The folded booklet bundle whose fore edge has been cut and aligned is flattened. Variations are caused in the fore edge cutting surface again. The quality of the booklet bundle can be lowered.

To improve the quality of the folded booklet bundle whose fore edge has been cut, it is considered that two opposed, top and tail edges of the folded booklet bundle crossing the fore edge are cut (hereinafter, called the top and tail edges cutting process).

However, when the flattened folded booklet bundle is subjected to the top and tail edges cutting process, the flattened folded end can be collapsed by the pressure of a cutter during the top and tail edges cutting process, thereby lowering the quality of the booklet bundle.

The present invention provides a sheet processing apparatus in which when a folded booklet bundle is subjected to a combination of a flattening process and a cutting process, the quality of the booklet bundle can be improved without lowering the quality of the booklet bundle.

Technical Solution

To achieve the above object, the present invention provides a sheet processing apparatus including: a deforming processing portion which presses a folded end of a folded booklet bundle to deform the folded end; and a cutting processing portion which cuts an edge of the booklet bundle; wherein edges crossing the folded end of the booklet bundle are cut by the cutting processing portion and the folded end of the booklet is then deformed by the deforming processing portion.

To achieve the above object, the present invention provides a sheet processing apparatus including: a deforming processing portion which presses a folded end of a folded booklet bundle to deform the folded end; and a cutting processing portion which cuts an edge opposite the folded end of the booklet bundle and edges crossing the folded end; wherein after the edges crossing the folded end of the booklet bundle are cut, the folded end of the booklet is deformed, and the edge opposite the folded end of the booklet bundle is then cut.

Advantageous Effects

According to the present invention, when the booklet bundle is subjected to a combination of the deforming process and the cutting process, the quality of the booklet bundle can be improved without lowering the quality of the booklet bundle.

Further features of the present invention will become apparent from the following description of exemplary embodiments (with reference to the attached drawings).

EXPLANATION OF REFERENCE

Figure 1:
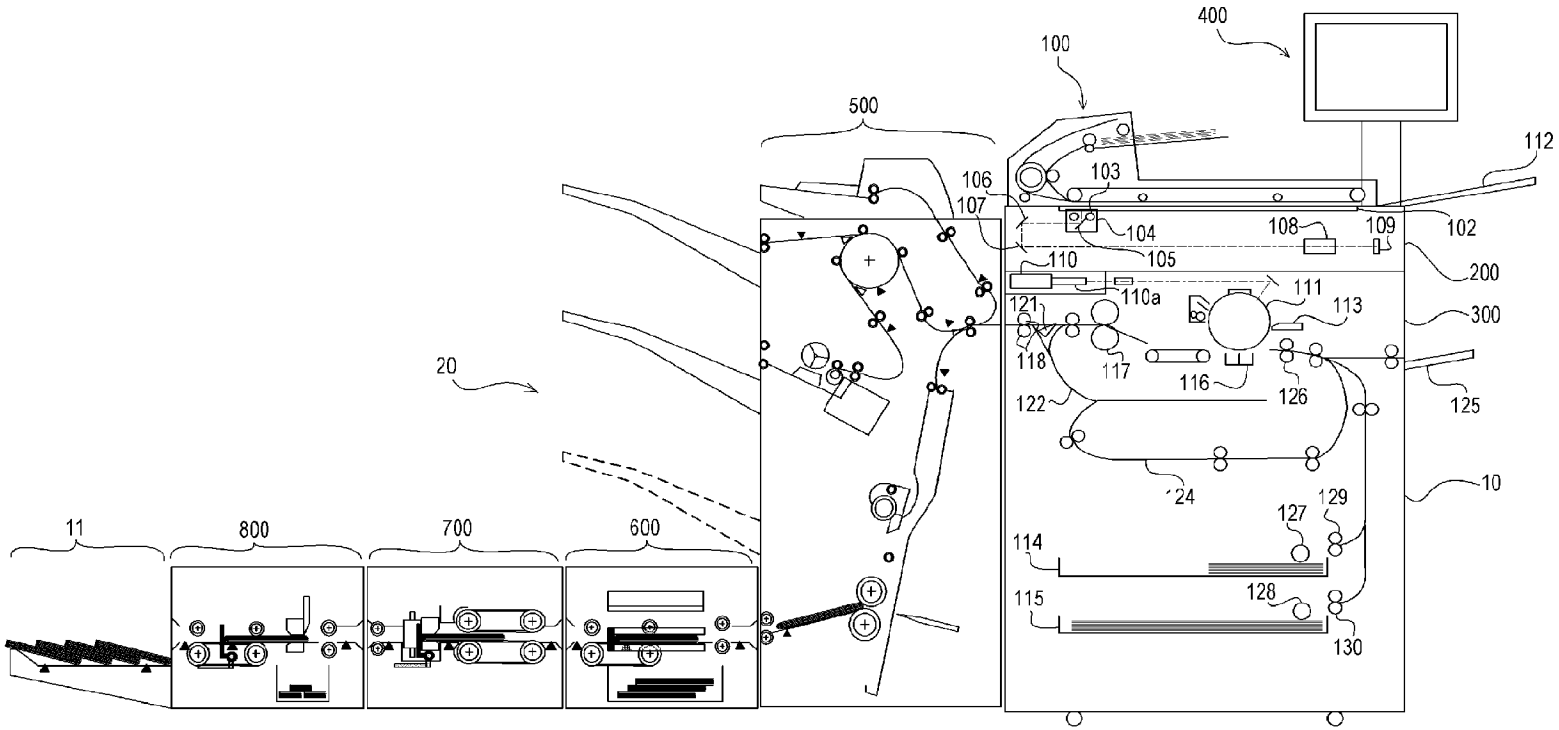
FIG. 1 is an overall block diagram of an image forming system.

B Booklet bundle
10 Image forming apparatus body
11 Bookbinding stack tray
20 Sheet processing apparatus
200 Image reader
300 Printer
400 Operation displaying unit
420 Operation displaying portion
500 Finisher
600 Top and tail edges cutting unit
700 Flattening processing unit
800 Fore edge cutting unit

BEST MODE FOR CARRYING OUT INVENTION

An exemplary embodiment of the present invention will be illustratively described below in detail with reference to the drawings. The dimensions, materials, shapes, relative arrangement of components described in the following embodiment should be changed appropriately by the configuration of an apparatus to which the present invention is applied and various conditions. Unless otherwise specified, the scope of the present invention is not limited to them.

An image forming system which has an image forming apparatus body and a sheet processing apparatus will be illustrated and described. There is illustrated the sheet processing apparatus in which discrete units which are a finisher, a top and tail edges cutting unit, a flattening processing unit, and a fore edge cutting unit configure a system. The present invention is not limited to this. The sheet processing apparatus may be integrated with various combinations of a finisher 500, a top and tail edges cutting unit 600, a flattening processing unit 700, and a fore edge cutting unit 800.

(Overall Configuration of Image Forming System)

The overall configuration of the image forming system will be described using FIG. 1. FIG. 1 is an overall block diagram illustrating the configuration of a main part of the image forming system.

As illustrated in FIG. 1, the image forming system has an image forming apparatus body 10 and a sheet processing apparatus 20. The sheet processing apparatus 20 has the finisher 500, the top and tail edges cutting unit 600, the flattening processing unit 700, and the fore edge cutting unit 800. The image forming apparatus body 10 has an image reader 200 which reads an image of an original, and a printer 300 which records the image on a sheet.

An original feeding unit 100 is mounted on the image reader 200. The original feeding unit 100 sequentially feeds each original set faceup on an original tray in page order. The original feeding unit 100 conveys the original to a reading position on a platen glass 102 via a curved path, and then discharges the original to an external discharge tray 112.

When the original passes through the reading position on the platen glass 102, the image of the original is read by a scanner unit 104 held in a position corresponding to the reading position. The reading method is generally called original scanning reading. Specifically, when the original passes through the reading position, the reading surface (the image surface) of the original is irradiated with light of a lamp 103 of the scanner unit 104. The reflection light from the original is guided to a lens 108 via mirrors 105, 106, and 107. The light which has passed through the lens 108 is focused onto the imaging surface of an image sensor 109.

The original is conveyed so as to pass through the reading position. There is performed the original reading scanning in which a direction perpendicular to the conveying direction of the original is a main scanning direction and the conveying direction is a sub-scanning direction. When the original passes through the reading position, the image of the original is read by the image sensor 109 on each line in the main scanning direction. The original is conveyed in the sub-scanning direction to read the entire image of the original. The optically read image is converted to image data by the image sensor 109 and is then output. The image data output from the image sensor 109 is subjected to a predetermined process in an image signal controlling portion 922 (see FIG. 2). Accordingly, the image data is then input as a video signal to an exposure controlling portion 110 of the printer 300.

The original is conveyed onto the platen glass 102 by the original feeding unit 100 and is then stopped in a predetermined position. In this state, the scanner unit 104 can scan and read the image of the original in the sub-scanning direction. The reading method is called original fixation reading.

When the original is read without using the original feeding unit 100, the user lifts the original feeding unit 100 to place the original on the platen glass 102. The scanner unit 104 scans and reads the original in the sub-scanning direction. When the image of the original is read without using the original feeding unit 100, the original fixation reading is performed.

The exposure controlling portion 110 of the printer 300 modulates and outputs a laser beam based on the input video signal. The scanning of the laser beam is performed with a polygon mirror 110*a*. A photosensitive drum 111 which configures the image forming portion is irradiated with the laser beam. An electrostatic latent image according to the scanning laser beam is formed on the photosensitive drum 111. As described later, the exposure controlling portion 110 outputs the laser beam at the original fixation reading so as to form a correct image (which is not a mirror image).

The electrostatic latent image on the photosensitive drum 111 is allowed to be a visible image as a developer image by a developer supplied from a development device 113. With a timing in synchronization with the start of the irradiation of the laser beam, the sheet is fed from cassettes 114 and 115, a manual feeding portion 125, or a duplex conveying path 124. The sheet is conveyed to between the photosensitive drum 111 and a transfer portion 116. The developer image formed on the photosensitive drum 111 is transferred onto the sheet fed by the transfer portion 116.

The sheet onto which the developer image has been transferred is conveyed to a fixing portion 117. The fixing portion 117 fixes the developer image onto the sheet by applying heat and pressure to the sheet. The sheet which has passed through the fixing portion 117 passes through a switching member 121 and a discharge roller 118 and is then discharged from the printer 300 to the outside (a finisher 500).

The sheet is discharged in the state that its image forming surface is set facedown. In this state, the sheet which has passed through the fixing portion 117 is guided once into a reversing path 122 by the switching operation of the switching member 121. Accordingly, the trailing end of the sheet passes through the switching member 121. The sheet is switched back and is then discharged from the printer 300 by the discharge roller 118. The discharge form is called reverse discharge. The reverse discharge is performed when the image is formed in page order, such as when the image read using the original feeding unit 100 is formed or when the image output from a computer is formed. The page order of the discharged sheets becomes correct.

The image is formed on a hard sheet such as an OHP sheet fed from the manual feeding portion 125. The sheet is discharged by the discharge roller 118 in the state that its image forming surface is set faceup without being guided into the reversing path 122.

When duplex recording which forms the image on two sides of the sheet is set, the sheet is guided into the reversing path 122 by the switching operation of the switching member 121 and is then conveyed to the duplex conveying path 124. There is performed control in which the sheet which has been guided to the duplex conveying path 124 is fed again to between the photosensitive drum 111 and the transfer portion 116 with the above timing.

The sheet which has been discharged from the printer 300 is conveyed to the sheet processing apparatus 20. The sheet processing apparatus 20 has the finisher 500, the top and tail edges cutting unit 600, the flattening processing unit 700, and the fore edge cutting unit 800 from the upstream side in the conveying direction in that order. The sheet which has been discharged from the printer 300 is conveyed to the finisher 500. The finisher 500 performs the respective processes such as a folding process which folds a bundle of a plurality of sheets at its center in two. The sheet bundle (hereinafter, called a booklet bundle) which has been folded by the finisher 500 passes through the top and tail edges cutting unit 600, the flattening processing unit 700, and the fore edge cutting unit 800. The booklet bundle is selectively subjected to the respective processes and is then discharged to a bookbinding stack tray 11. As described later, the fore edge cutting unit 800 and the top and tail edges cutting unit 600 cut edges of the booklet bundle which has been folded by the finisher 500. The flattening processing unit 700, served as a deforming processing portion which deforms a folded end, performs a flattening process which presses and flattens a folded end of the folded booklet bundle. The flattening process is a deforming process, where the folded end of the folded booklet bundle is deformed into "square back" shape having corners by the flattening process. Accordingly, the booklet bundle as a final product which has been selectively subjected to the respective processes is discharged to the bookbinding stack tray 11.

(Controller of Image Forming System)

Figure 2:
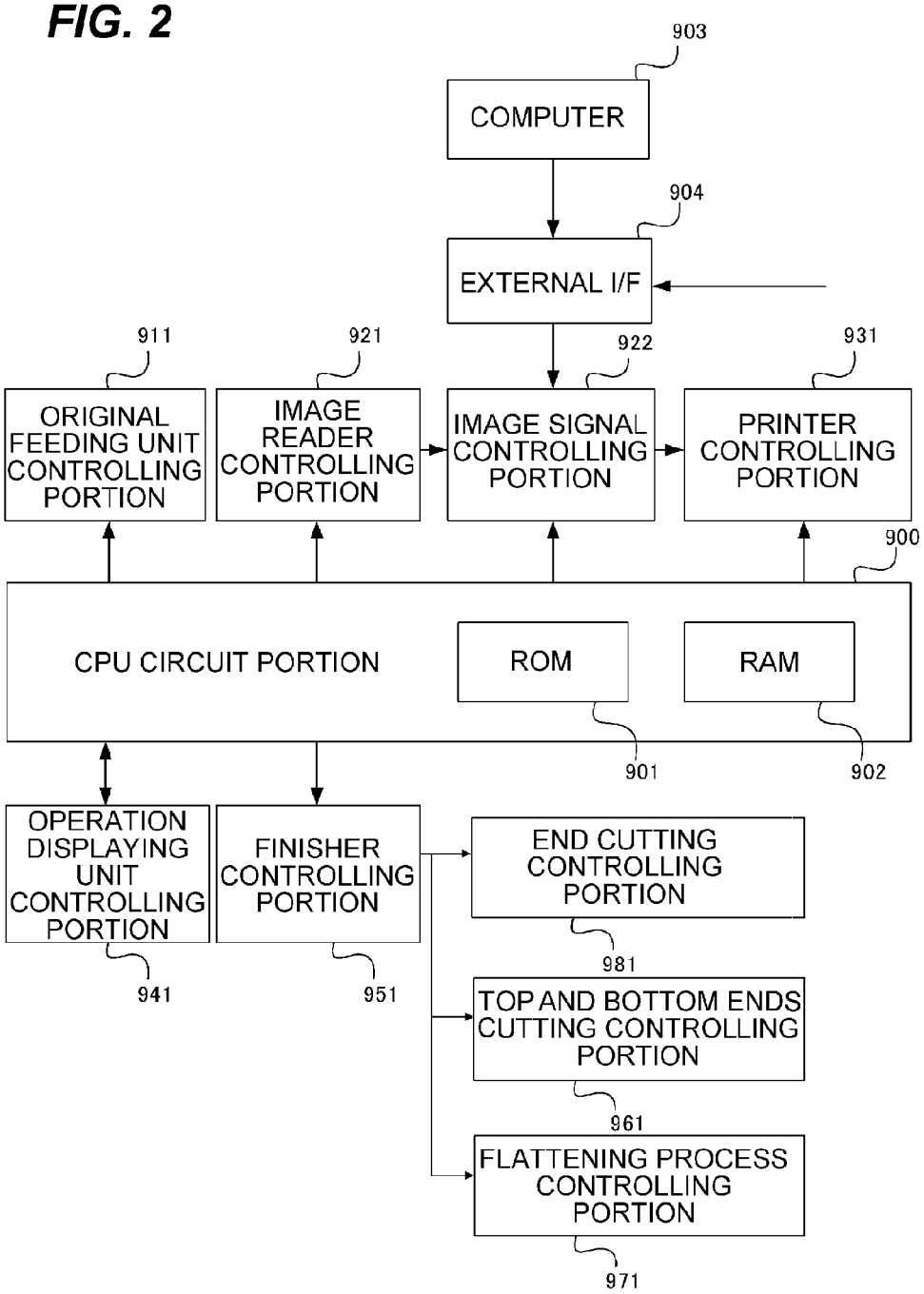
FIG. 2 is a block diagram of a controller of the entire image forming system.

The configuration of a controller which controls the entire image forming system will be described with reference to FIG. 2. FIG. 2 is an overall block diagram illustrating the configuration of the controller which controls the entire image forming system of FIG. 1.

As illustrated in FIG. 2, the controller has a CPU circuit portion 900. The CPU circuit portion 900 is mounted on the image forming apparatus body 10. The CPU circuit portion 900 incorporates a CPU (not illustrated), a ROM 901, and a RAM 902 thereinto. The CPU circuit portion 900 generally controls blocks 911, 921, 922, 931, 941, and 951 by a control program stored in the ROM 901. The RAM 902 temporarily holds control data and is used as an operating area of a computing process with control.

The original feeding unit controlling portion 911 drivingly controls the original feeding unit 100 based on an instruction from the CPU circuit portion 900. The image reader controlling portion 921 drivingly controls the scanner unit 104 and the image sensor 109 and transfers an analog image signal output from the image sensor 109 to the image signal controlling portion 922.

The image signal controlling portion 922 converts the analog image signal from the image sensor 109 to a digital signal and then subjects the digital signal to the respective processes. Accordingly, the image signal controlling portion 922 converts the digital signal to a video signal and then outputs the video signal to the printer controlling portion 931. The image signal controlling portion 922 subjects a digital image signal input from a computer 903 via an external I/F 904 to the respective processes and converts the digital image signal to a video signal and then outputs the video signal to the printer controlling portion 931. The processing operation by the image signal controlling portion 922 is controlled by the CPU circuit portion 900. The printer controlling portion 931 drives the exposure controlling portion 110 based on the input video signal.

The operation displaying unit controlling portion 941 transmits and receives information between an operation displaying unit 400 (see FIG. 1) and the CPU circuit portion 900. The operation displaying unit 400 is mounted on the image forming apparatus body 10. The operation displaying unit 400 has a plurality of keys which set various functions about image formation, and a displaying portion which displays information which shows the set state. The operation displaying unit controlling portion 941 outputs a key signal corresponding to the operation of each of the keys to the CPU circuit portion 900. The operation displaying unit controlling portion 941 displays the corresponding information based on the signal from the CPU circuit portion 900 on the displaying portion.

The finisher controlling portion 951 is mounted on the finisher 500. The finisher controlling portion 951 transmits and receives information to/from the CPU circuit portion 900 to drivingly control the entire finisher. The controlled contents will be described later. The finisher controlling portion 951 generally controls blocks 961, 971, and 981.

The edge cutting controlling portion 981 is mounted on the fore edge cutting unit 800. The fore edge cutting controlling portion 981 transmits and receives information to/from the finisher controlling portion 951 to drivingly control the entire fore edge cutting unit. The control will be described later.

The top and tail edges cutting controlling portion 961 is mounted on the top and tail edges cutting unit 600. The top and tail edges cutting controlling portion 961 transmits and receives information to/from the finisher controlling portion 951 to drivingly control the entire top and tail edges cutting unit. The control will be described later.

The flattening process controlling portion 971 is mounted on the flattening processing unit 700. The flattening process controlling portion 971 transmits and receives information to/from the finisher controlling portion 951 to drivingly control the entire flattening processing unit. The control will be described later.

In this embodiment, the image forming system is controlled by the communication between the CPU circuit portion 900 and the finisher controlling portion 951 and the communication between the finisher controlling portion 951, the fore edge cutting controlling portion 981, the top and tail edges cutting controlling portion 961, and the flattening process controlling portion 971. The present invention is not limited to this. The finisher controlling portion 951 may be provided in the image forming apparatus body 10 so as to be integrated with the CPU circuit portion 900. Alternatively, the fore edge cutting controlling portion 981, the top and tail edges cutting controlling portion 961, and the flattening process controlling portion 971 may be provided in the finisher 500 so as to be integrated with the finisher controlling portion 951.

(Operation Displaying Unit)

Figure 28:
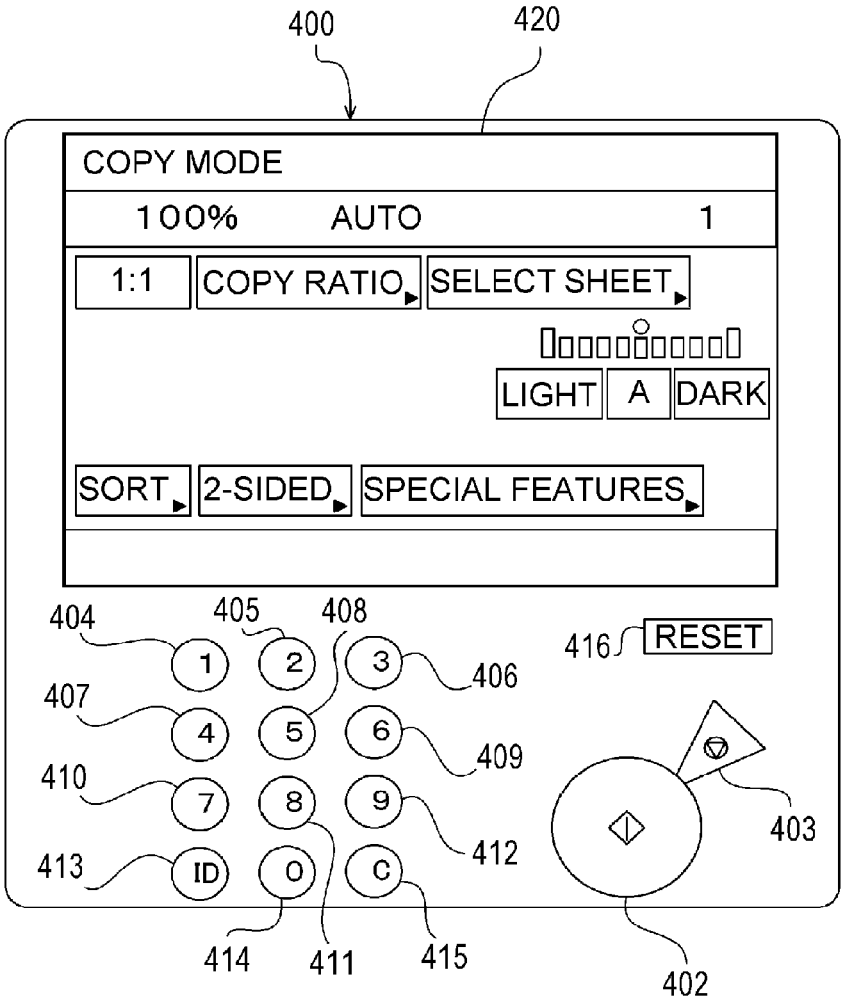
FIG. 28 is a diagram describing an operation displaying portion of an operation displaying unit.

FIG. 28 is a plan view illustrating the operation displaying unit 400 in the image forming system of FIG. 1. As illustrated in FIG. 28, various keys are arranged in the operation displaying unit 400. A start key 402 starts the image forming operation. A stop key 403 stops the image forming operation. Numeric keys 404 to 412 and 414 perform numeric setting. An ID key 413, a clear key 415, and a reset key 416 are provided. A user mode key 417 sets various units. An operation displaying portion 420 formed with a touch panel is arranged in the upper portion of the operation displaying unit 400 and can create a soft-key on the screen.

The image forming system has processing modes such as non-sort, sort, staple sort (binding mode), and a bookbinding mode. Such processing modes are set by the input operation from the operation displaying unit 400 or the computer 903. When the processing mode is set to select the soft-key "sort" on the initial screen illustrated in FIG. 28, the menu selection screen is displayed on the operation displaying portion 420 or a monitor, not illustrated. The processing mode is then set using the menu selection screen.

In FIG. 1, a side where the user faces the operation displaying portion 420 of the operation displaying unit 400 is the front side of the apparatus. A side where the user stands in front of the apparatus is the front side of the apparatus. A side far from the user is the rear side.

(Finisher)

Figure 3:
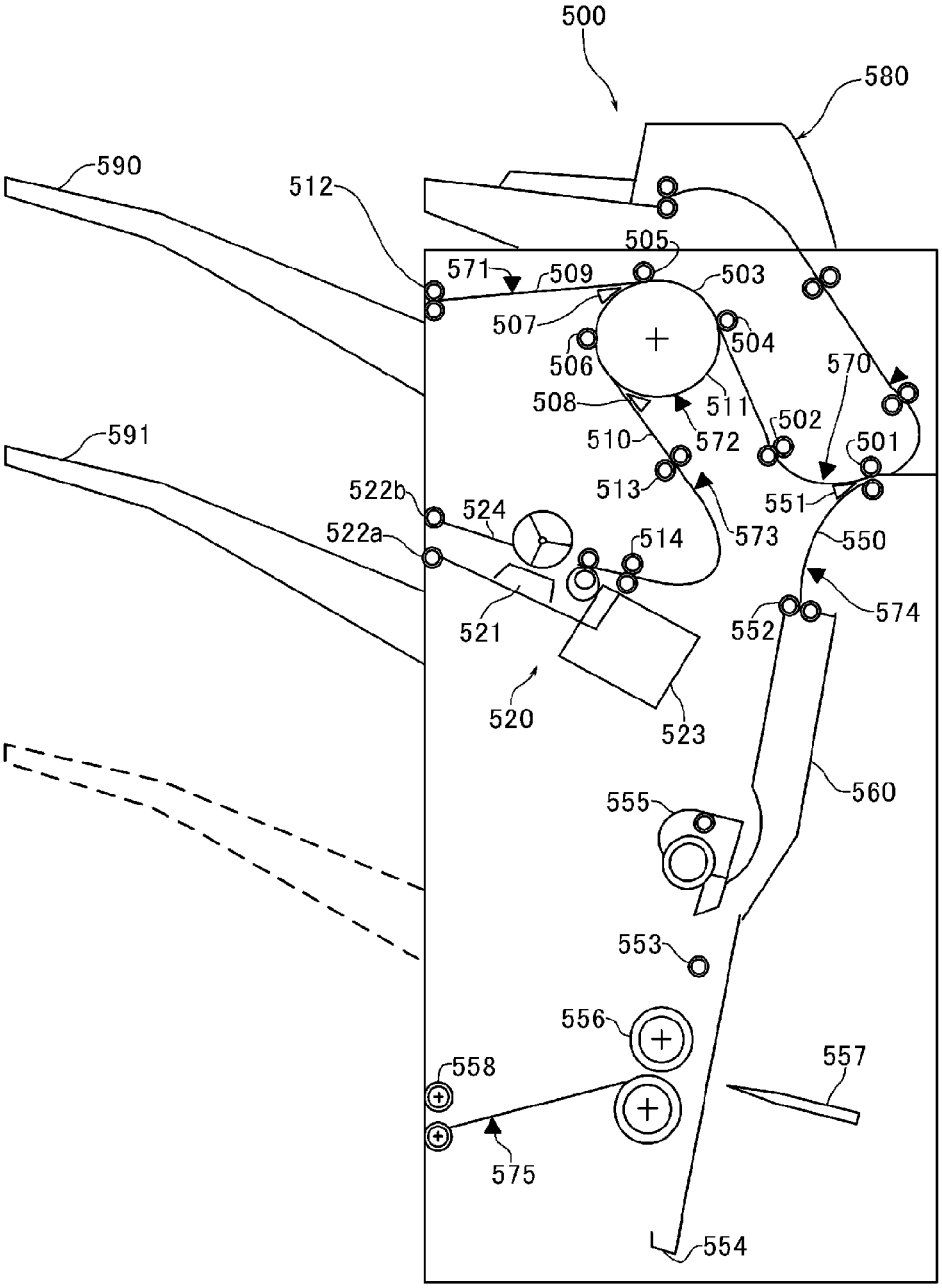
FIG. 3 is a cross-sectional view of a finisher.

The configuration of the finisher 500 will be described with reference to FIG. 3. FIG. 3 is a block diagram of the finisher 500 of FIG. 1.

The finisher 500 sequentially takes in the sheets discharged from the image forming apparatus body 10 to selectively subject the sheets to the following predetermined processes. As the predetermined processes, there are a process which aligns and bundles the taken-in sheets, a stapling process which staples the trailing end of the sheet bundle, a punch process which punches the taken-in sheets near their trailing ends, a sort process, a non-sort process, and a bookbinding process.

As illustrated in FIG. 3, the finisher 500 takes in the sheet discharged from the image forming apparatus body 10 by a pair of inlet rollers 501. The sheet taken in by the pair of inlet rollers 501 is conveyed to a buffer roller 503 via a pair of conveying rollers 502. An inlet sensor 570 is provided midway the conveying path between the pair of inlet rollers 501 and the pair of conveying rollers 502.

A switching member 551 is arranged on the downstream side of the pair of inlet rollers 501 and can switch between a sort path 510 or a non-sort path 509 and a bookbinding path 550.

The buffer roller 503 is a roller which can wind a predetermined number of the stacked sheets conveyed via the pair of conveying rollers 502 around the outer circumference of the buffer roller 503. The sheets are wound around the outer circumference of the roller by depressing rollers 504, 505, and 506 during rotation. The wound sheets are conveyed in the rotating direction of the buffer roller 503.

A switching member 507 is arranged between the depressing rollers 505 and 506. A switching member 508 is arranged on the downstream side of the depressing roller 506. The switching member 507 is a switching member which separates the sheets wound around the buffer roller 503 from the buffer roller 503 to guide the sheets to the non-sort path 509 or the sort path 510. The switching member 508 is a switching member which separates the sheets wound around the buffer roller 503 from the buffer roller 503 to guide the sheets to the sort path 510 or the sheets wound around the buffer roller 503 to a buffer path 511.

When the sheets wound around the buffer roller 503 are guided to the non-sort path 509, the switching member 507 is operated to separate the wound sheets from the buffer roller 503 to guide the sheets to the non-sort path 509. The sheets guided to the non-sort path 509 are discharged onto a sample tray 590 via a pair of discharge rollers 512. A discharge sensor 571 is provided midway the non-sort path 509.

When the sheets wound around the buffer roller 503 are guided to the buffer path 511, the switching members 507 and 508 are not operated, and the sheets wound around the buffer roller 503 are conveyed to the buffer path 511. A buffer path sensor 572 which detects the sheets on the buffer path 511 is provided midway the buffer path 511.

When the sheets wound around the buffer roller 503 are guided to the sort path 510, the switching member 507 is not operated and the switching member 508 is operated. The wound sheets are separated from the buffer roller 503 and are then guided to the sort path 510.

The sheets guided to the sort path 510 are stacked on an intermediate tray (hereinafter, called a processing tray) 520 via a pair of conveying rollers 513 and 514. The sheet bundle stacked on the processing tray 520 is aligned by aligning members 521 provided on the front and rear sides and is stapled, if necessary. Accordingly, the sheet is discharged onto a stack tray 591 by discharge rollers 522*a* and 522*b*. The discharge roller 522*b* is supported by a swinging guide 524. The swinging guide 524 is swung so as to abut the discharge roller 522*b* onto the topmost sheet on the processing tray 520 by a swinging motor (not illustrated). In a state that the discharge roller 522*b* is abutted onto the topmost sheet on the processing tray 520, the discharge roller 522*b* cooperates with the discharge roller 522*a* to discharge the sheet bundle on the processing tray 520 toward the stack tray 591.

The stapling process is performed by a stapler 523. The stapler 523 can be moved along the outer periphery of the processing tray 520 and can bind the sheet bundle stacked on the processing tray 520 in the trailing position (the trailing end) of the sheets in the sheet conveying direction.

The sheet guided to the bookbinding path 550 by the switching member 551 is subjected to the folding process which folds the sheet bundle at its center in two by a folding mechanism as a folding processing portion described below. The sheet guided to the bookbinding path 550 is conveyed to a bookbinding intermediate tray (hereinafter, called a bookbinding processing tray) 560 via a pair of conveying rollers 552. A bookbinding inlet sensor 574 is provided midway along the bookbinding path 550. An intermediate roller 553 and a movable sheet positioning member 554 are provided to the bookbinding processing tray 560. An anvil (not illustrated) is provided in a position opposite a stapler 555. The stapler 555 cooperates with the anvil to staple the sheet bundle stored in the bookbinding processing tray 560.

A pair of folding rollers 556 and a protruding member 557 provided in the opposite position of the pair of folding rollers 556 are provided on the downstream side of the stapler 555. The protruding member 557 is protruded toward the sheet bundle stored in the bookbinding processing tray 560. The sheet bundle stored in the bookbinding processing tray 560 is then pushed out to between the pair of folding rollers 556. The pair of folding rollers 556 fold the sheet bundle and then convey the sheet bundle to the downstream side. The folded sheet bundle (booklet bundle) is conveyed to the unit on the downstream side in the conveying direction via a pair of conveying rollers 558. A discharge sensor 575 is provided on the downstream side of the pair of conveying rollers 558.

(Operation of Folding Process in Bookbinding Mode)

The flow of the operation of the bookbinding mode by the folding process by the finisher 500 will be described with reference to FIGS. 4 to 8.

Figure 4:
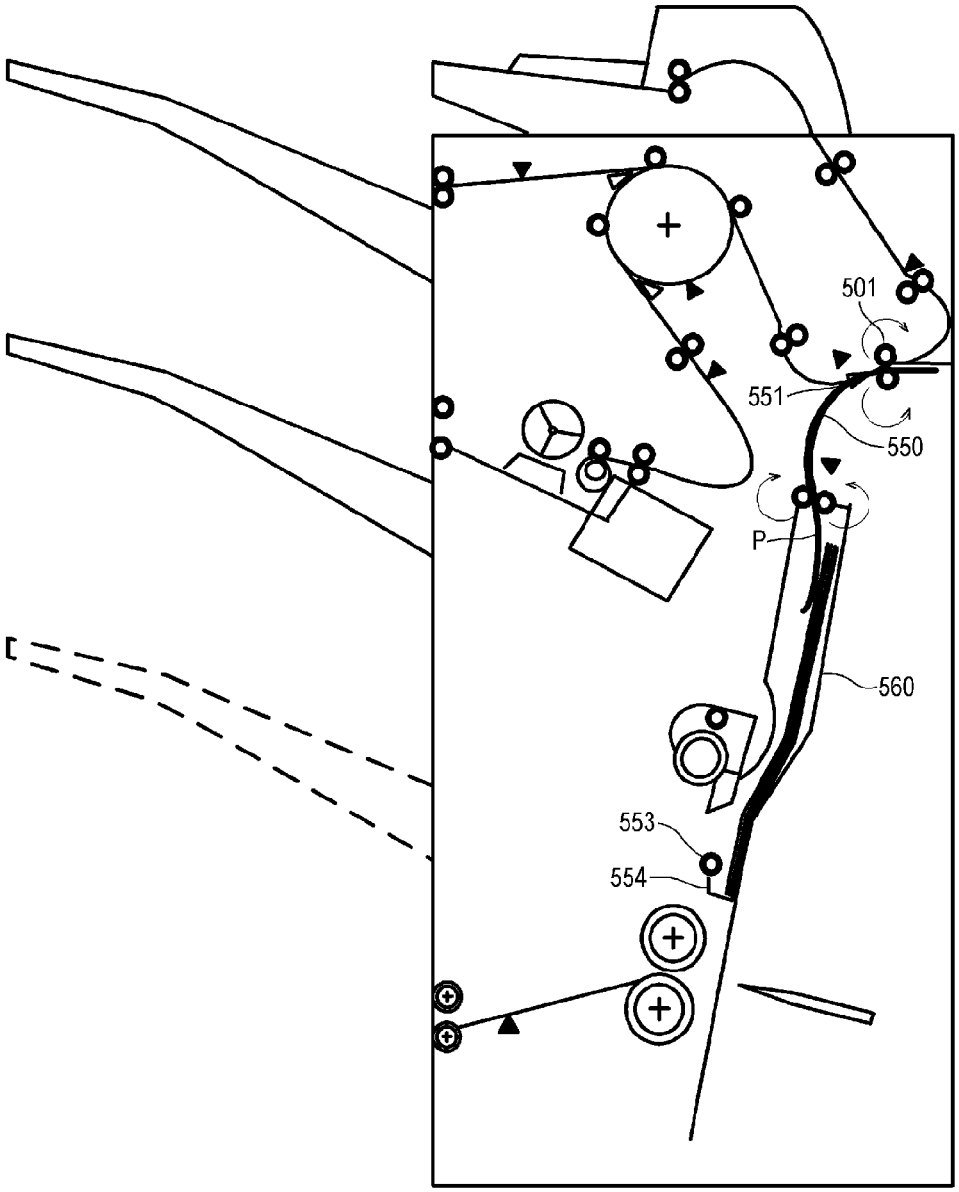
FIG. 4 is a cross-sectional view of the finisher which performs the operation of the folding process.

When the bookbinding mode is specified, as illustrated in FIG. 4, the pair of inlet rollers 501 and the pair of conveying rollers 552 are rotationally driven, and a sheet P discharged from the image forming apparatus body 10 is taken in the finisher 500 and is then conveyed. The switching member 551 is held in the state that the sheet P is guided to the bookbinding path 550. The sheet P is stored in the bookbinding processing tray 560 by the pair of conveying rollers 552. The intermediate roller 553 is rotationally driven. The sheet stored in the bookbinding processing tray 560 is conveyed until the leading end of the sheet is brought into contact with the sheet positioning member 554. When the leading end of the sheet reaches the positioning member 554 to stop conveying, the aligning member (not illustrated) is operated in a direction perpendicular to the sheet conveying direction to align the sheet.

Figure 5:
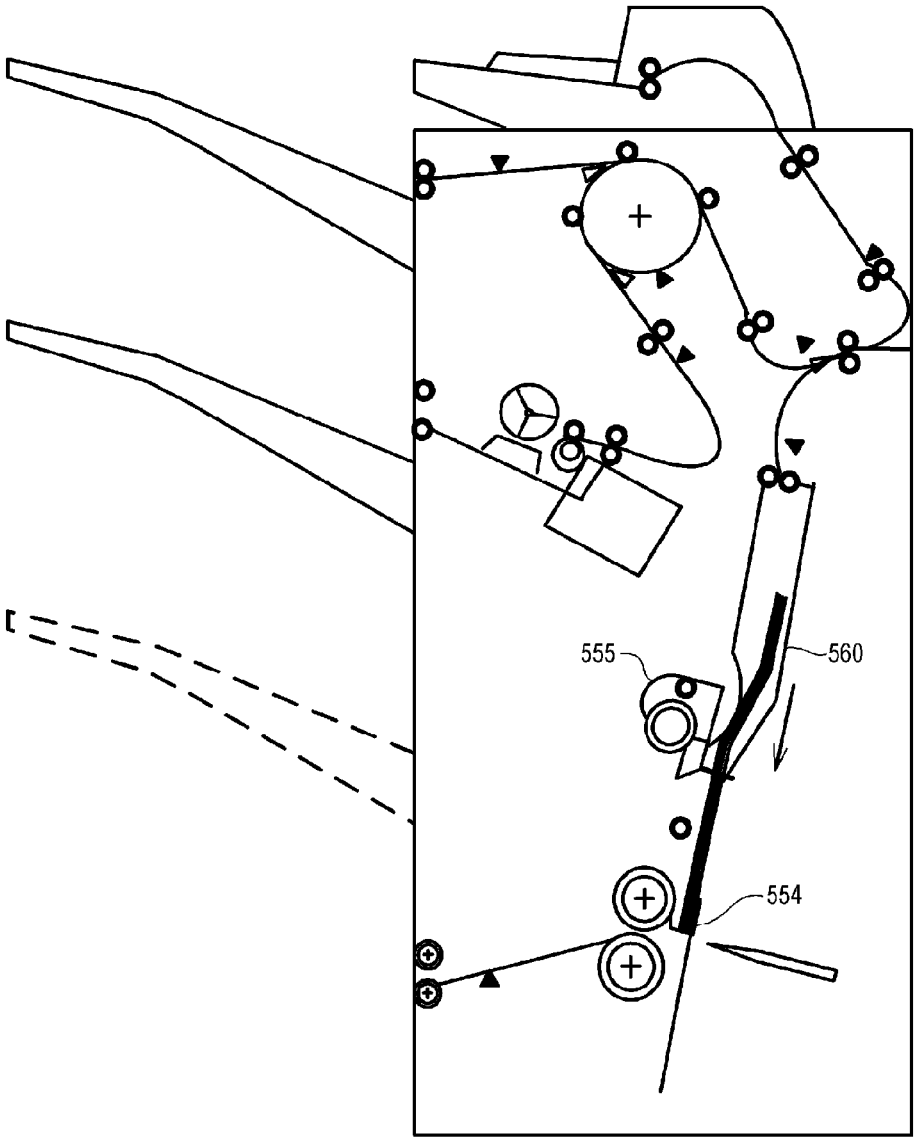
FIG. 5 is a cross-sectional view of the finisher which performs the operation of the folding process.

When a predetermined number of sheets are aligned and stored, as illustrated in FIG. 5, the sheet positioning member 554 is moved to a position where the stored sheet bundle is stapled at its center. The sheet bundle is stapled at its center by the stapler 555 (hereinafter, the saddle stitch process). When the saddle stitch process is not performed, the process is advanced to the next step without performing the saddle stitch process.

Figure 6:
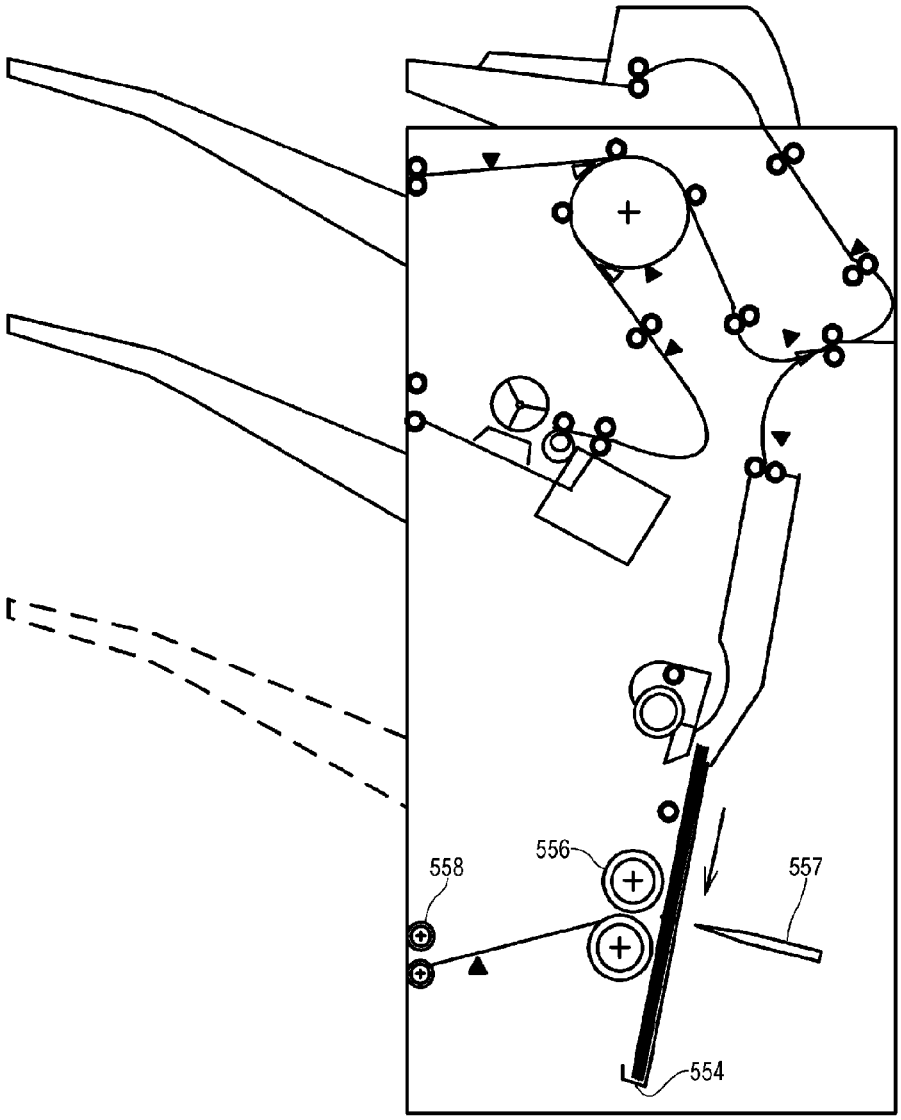
FIG. 6 is a cross-sectional view of the finisher which performs the operation of the folding process.
Figure 7:
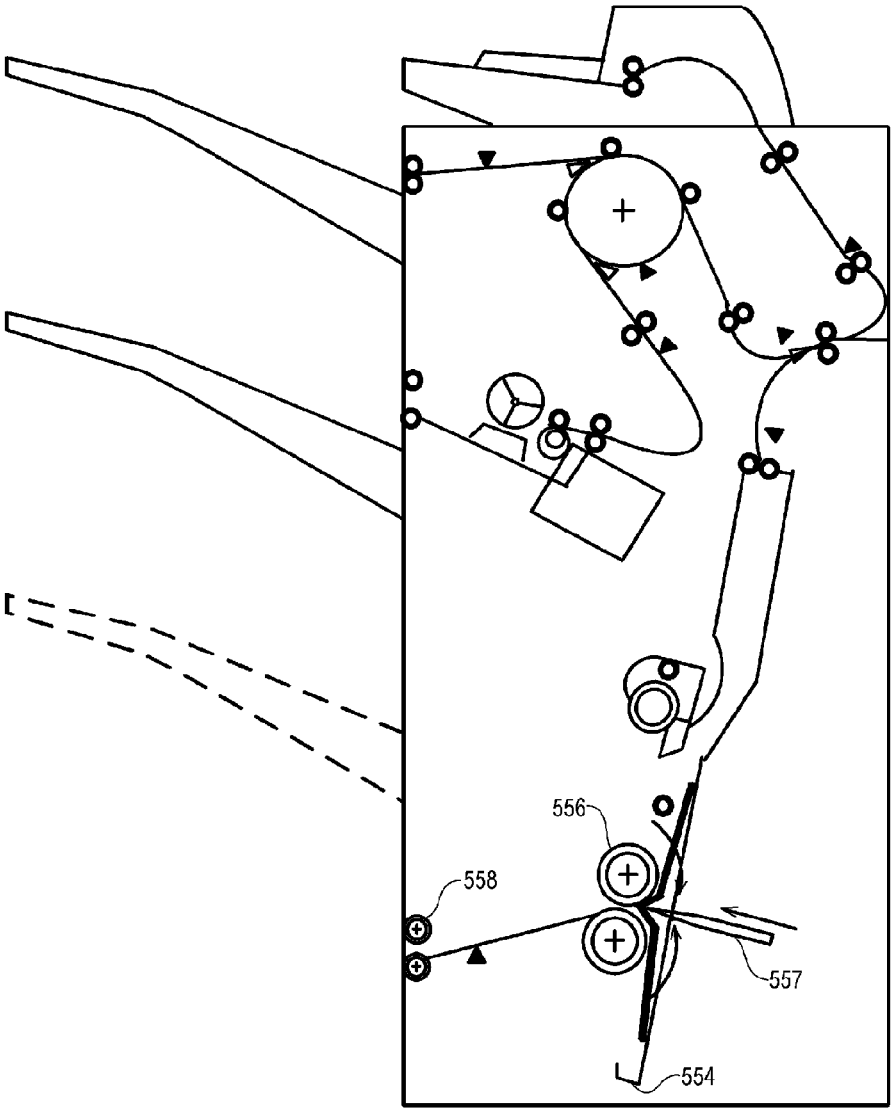
FIG. 7 is a cross-sectional view of the finisher which performs the operation of the folding process.

As illustrated in FIGS. 6 and 7, the sheet positioning member 554 is lowered to a position where the stapling position (the center of the sheet) is the center position of the pair of folding rollers 556. The pair of folding rollers 556 and the pair of conveying rollers 558 are rotationally driven, and at the same time, the protruding member 557 is protruded to push out the sheet bundle to between the pair of folding rollers 556.

Figure 8:
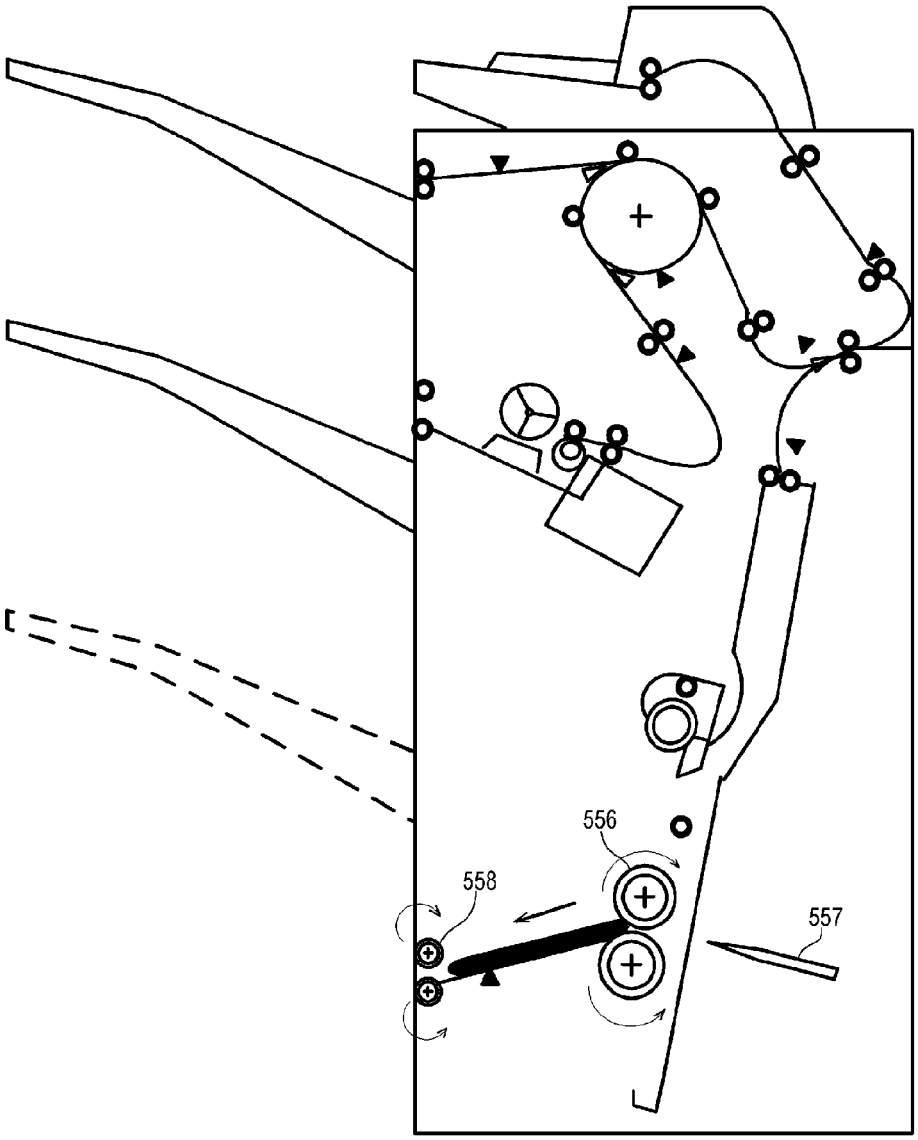
FIG. 8 is a cross-sectional view of the finisher which performs the operation of the folding process.

As illustrated in FIG. 8, the sheet bundle is conveyed to the downstream side while being folded by the pair of folding rollers 556. The sheet bundle is discharged to the outside of the apparatus or the different unit by the pair of conveying rollers 558.

The sheet bundle (hereinafter, called a booklet bundle) which has been folded by the finisher 500 sequentially passes through the top and tail edges cutting unit 600, the flattening processing unit 700, and the fore edge cutting unit 800. The sheet bundle is selectively subjected to the respective processes and discharged onto the bookbinding stack tray 11.

Here, the respective configurations of the top and tail edges cutting unit 600, the flattening processing unit 700, and the fore edge cutting unit 800 will be described from the upstream side in the conveying direction.

(Top and Tail Edges Cutting Unit)

Figure 21A:
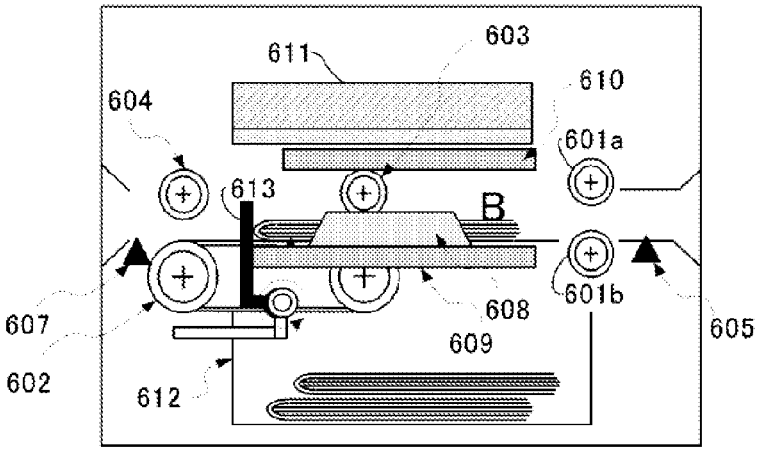
FIG. 21A is a cross-sectional view of a top and tail edges cutting unit.
Figure 21B:
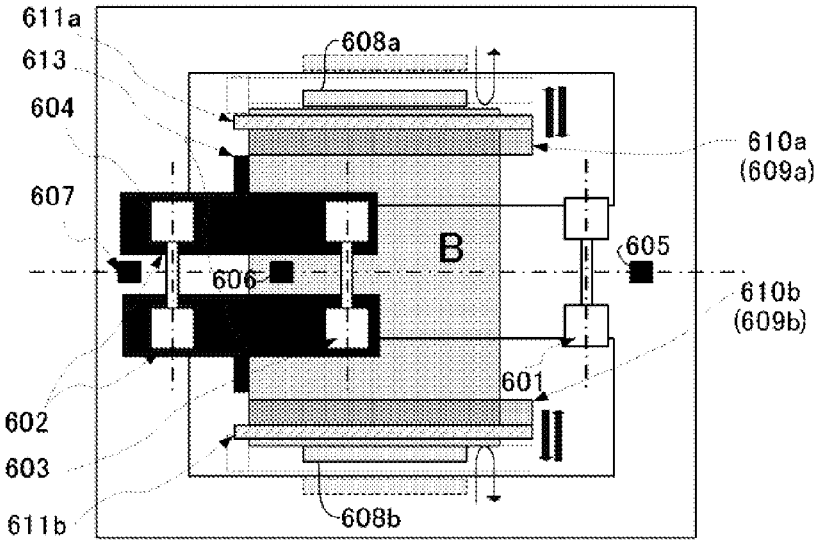
FIG. 21B is a top view of the top and tail edges cutting unit.
Figure 22A:
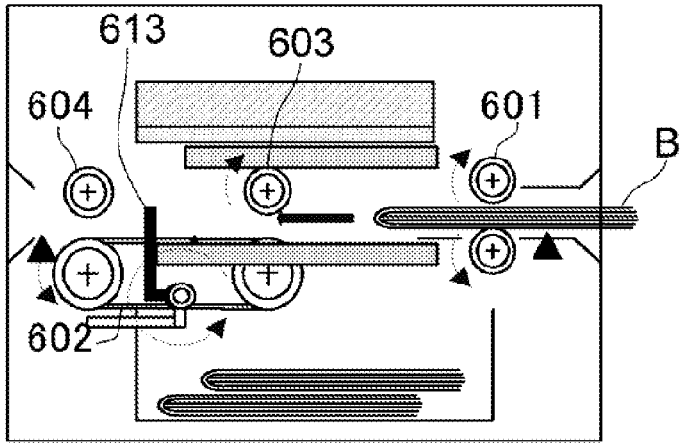
FIG. 22A is a cross-sectional view of the top and tail edges cutting unit which performs the operation of the top and tail edges cutting process.
Figure 22B:
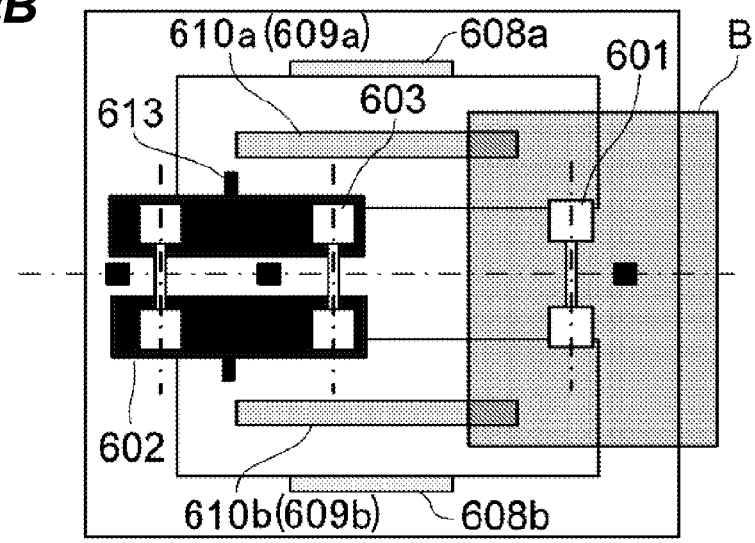
FIG. 22B is a top view of the top and tail edges cutting unit which performs the operation of the top and tail edges cutting process.
Figure 23A:
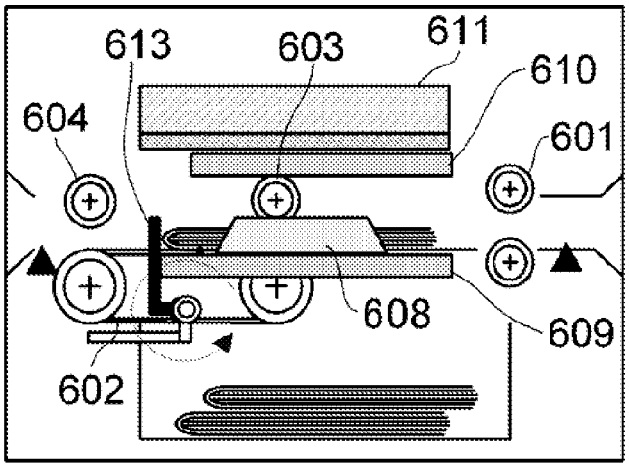
FIG. 23A is a cross-sectional view of the top and tail edges cutting unit which performs the operation of the top and tail edges cutting process.
Figure 23B:
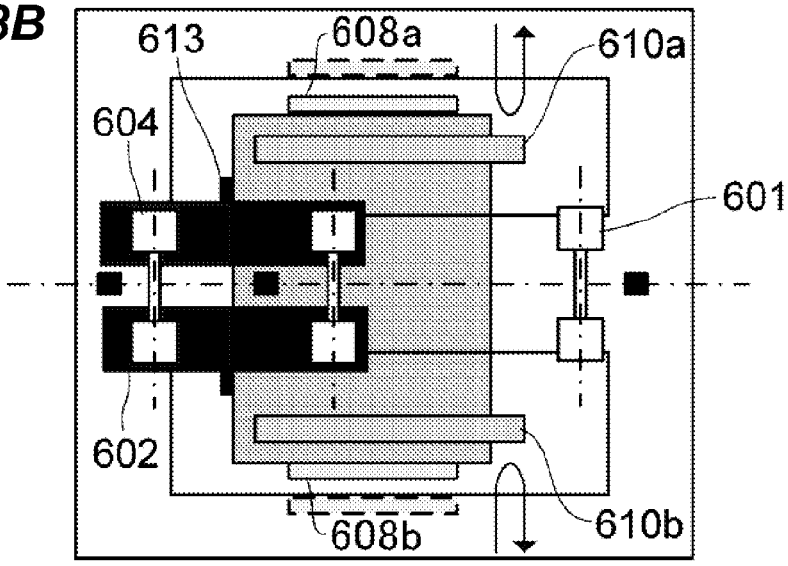
FIG. 23B is a top view of the top and tail edges cutting unit which performs the operation of the top and tail edges cutting process.
Figure 24A:
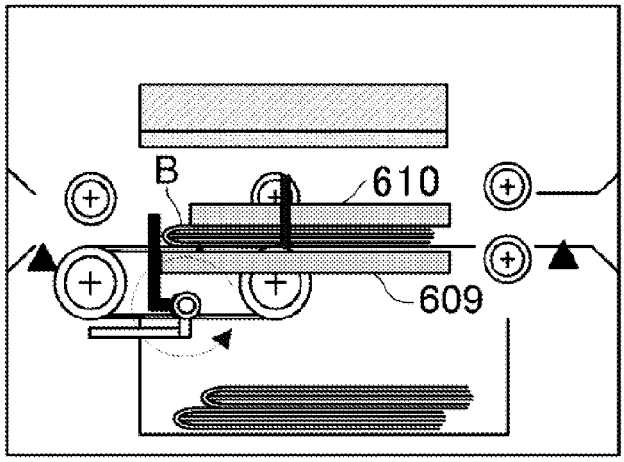
FIG. 24A is a cross-sectional view of the top and tail edges cutting unit which performs the operation of the top and tail edges cutting process.
Figure 24B:
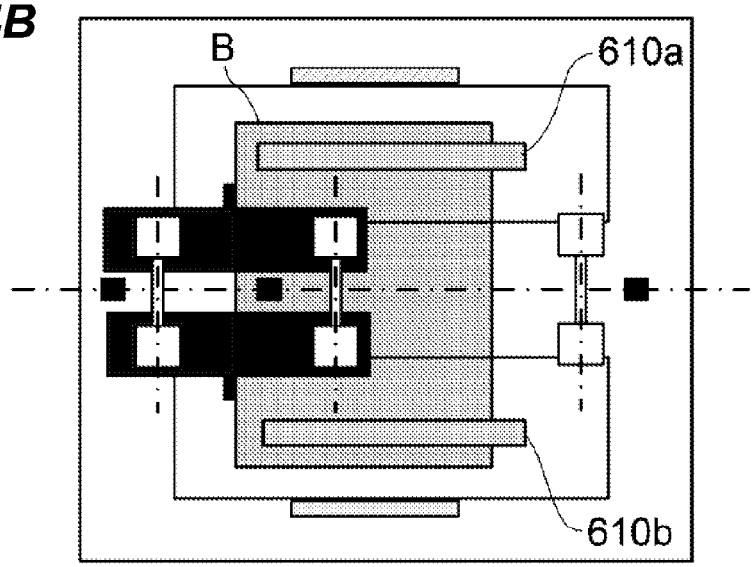
FIG. 24B is a top view of the top and tail edges cutting unit which performs the operation of the top and tail edges cutting process.

The configuration of the top and tail edges cutting unit 600 will be described with reference to FIG. 21. FIG. 21 is a diagram describing the top and tail edges cutting unit 600 of FIG. 1, in which FIG. 21A is a cross-sectional view and FIG. 21B is a top view.

The top and tail edges cutting unit 600 is a top and tail edges cutting processing portion which cuts top and tail edges crossing a folded end of a folded booklet bundle B. The top and tail edges cutting unit 600 configures the cutting processing portion which cuts and aligns the edges of the booklet bundle B together with the fore edge cutting unit 800.

The top and tail edges cutting unit 600 receives the booklet bundle B which has been folded by the bookbinding processing portion of the finisher 500 at the center reference by an inlet conveying roller 601.

The inlet conveying roller 601 has an upper conveying roller 601*a* and a lower conveying roller 601*b*. The upper conveying roller 601*a* is moved in the up and down directions by a spring (not illustrated) and can receive the booklet bundle whose thickness is changed.

A belt conveying roller 602, a conveying roller 603, and a discharge conveying roller 604 are arranged on the downstream side of the inlet conveying roller 601. The discharge conveying roller 604 is moved in the up and down directions by a spring (not illustrated). The conveying roller 603 can be moved away from the booklet bundle B by a solenoid (not illustrated).

A skew feeding correction stopper 613 which corrects the skew feeding of the received booklet bundle B on the downstream side of the conveying roller 603. The skew feeding correction stopper 613 completes the correction of the skew feeding so as to be rotationally retracted. Accordingly, the booklet bundle B is received by the discharge conveying roller 604.

An aligning plate 608 has an aligning plate 608*a* on the rear side of the apparatus and an aligning plate 608*b* on the front side of the apparatus. The aligning plate 608 performs the aligning operation in a direction perpendicular to the conveying direction such that the center position of the booklet bundle B whose skew feeding has been corrected by the skew feeding correction stopper 613 is a predetermined position.

A lower cutting guide 609 and an upper cutting guide 610 have a lower cutting guide 609*a* and an upper cutting guide 610*a* on the rear side of the apparatus, and a lower cutting guide 609*b* and an upper cutting guide 610*b* on the front side of the apparatus. The lower cutting guide 609 and the upper cutting guide 610 can be moved in a direction perpendicular to the conveying direction according to the cutting position. The guides 609 and 610 are moved in the rear and front directions of the apparatus according to the booklet bundle size and the amount of cutting such that the ends of the guides 609 and 610 are in the cutting position. The upper cutting guide 610 presses the booklet bundle from above so as not to shift the booklet bundle during cutting.

A cutter 611 has a cutter 611*a* on the rear side of the apparatus and a cutter 611*b* on the front side of the apparatus. The cutters 611*a* and 611*b* are moved with movement of the lower cutting guide 609 and the upper cutting guide 610 on the rear and front sides of the apparatus to perform the cutting operation along the guide end surfaces. The paper waste of the cut top and tail edges is stored in a trash box 612.

In the conveying path, there are provided an inlet sensor 605 which detects that the booklet bundle B has been conveyed into the top and tail edges cutting unit 600, a sensor 606 which detects that the booklet bundle B has reached the skew feeding correction position, and a discharge outlet sensor 607 which detects that the booklet bundle B has been discharged from the top and tail edges cutting unit 600.

(Operation of Top and Tail Edges Cutting Process)

The flow of the operation of the top and tail edges cutting process will be described. FIGS. 22 to 27 are diagrams describing the operation of the top and tail edges cutting process, in which FIGS. 22A, 23A, 24A, 25B, 26A, and 27A are cross-sectional views and FIGS. 22B, 23B, 24B, 25B, 26B, and 27B are top views.

As illustrated in FIG. 22, the folded booklet bundle B is conveyed to the inlet conveying roller 601 at the center reference. The booklet bundle B is then conveyed to the skew feeding correction stopper 613 by the driving of the belt conveying roller 602 and the conveying roller 603. In this state, the upper cutting guide 610 is retracted upward, and the aligning plate 608 is retracted to the outside in a direction perpendicular to the conveying direction. The skew feeding correction stopper 613 has already been on standby in the skew feeding correction position.

As illustrated in FIG. 23, the booklet bundle B is abutted onto the skew feeding correction stopper 613 to correct the skew feeding. Accordingly, the inlet conveying roller 601, the belt conveying roller 602, and the conveying roller 603 are stopped to perform the aligning operation by the aligning plate 608. The conveying roller 603 is moved away and retracted from the booklet bundle B during the aligning operation. After the completion of the aligning operation, the conveying roller 603 releases moving-away from the booklet bundle B, and the book bundle B is abutted onto the skew feeding correction stopper 613 again. The position of the booklet bundle B is determined. The lower cutting guide 609 and the upper cutting guide 610 are moved to the cutting position. With this, the cutter 611 is moved to the cutting position. As illustrated in FIG. 24, the booklet bundle B is fixed by lowering the upper cutting guide 610.

Figure 25A:
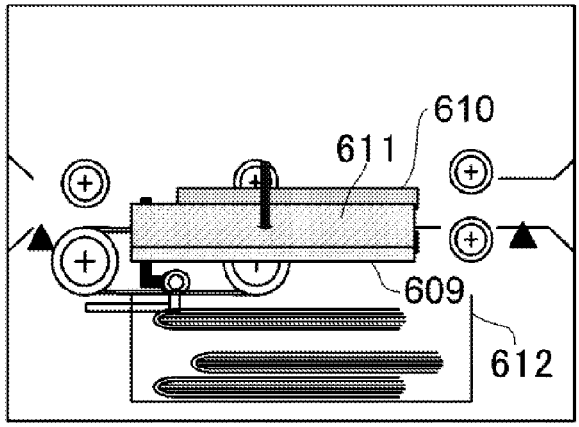
FIG. 25A is a cross-sectional view of the top and tail edges cutting unit which performs the operation of the top and tail edges cutting process.
Figure 25B:
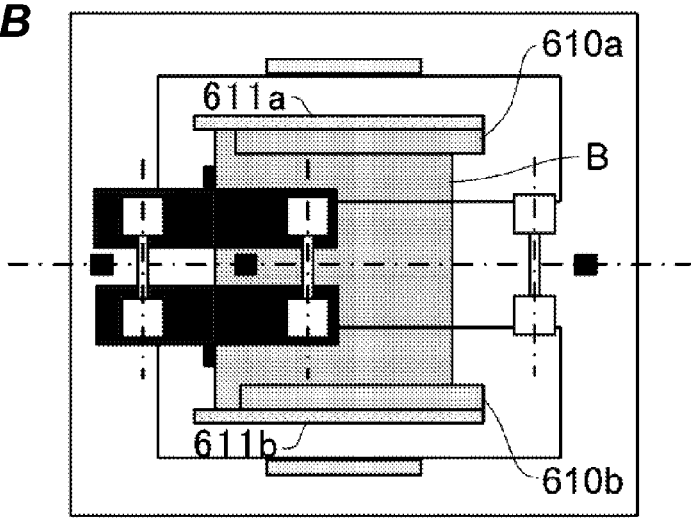
FIG. 25B is a top view of the top and tail edges cutting unit which performs the operation of the top and tail edges cutting process.
Figure 26A:
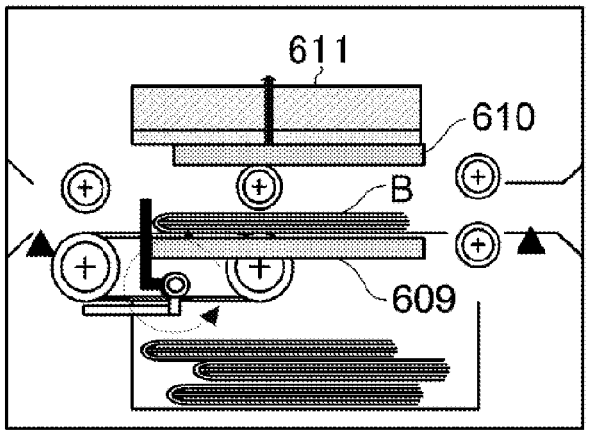
FIG. 26A is a cross-sectional view of the top and tail edges cutting unit which performs the operation of the top and tail edges cutting process.
Figure 26B:
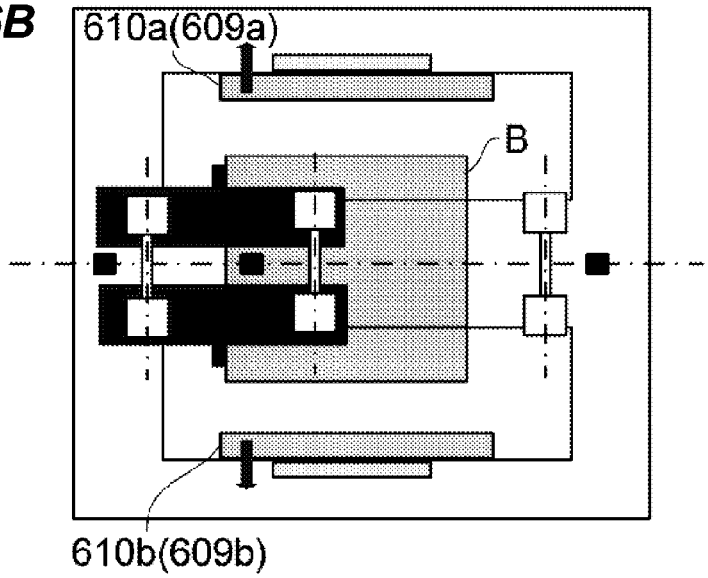
FIG. 26B is a top view of the top and tail edges cutting unit which performs the operation of the top and tail edges cutting process.
Figure 27A:
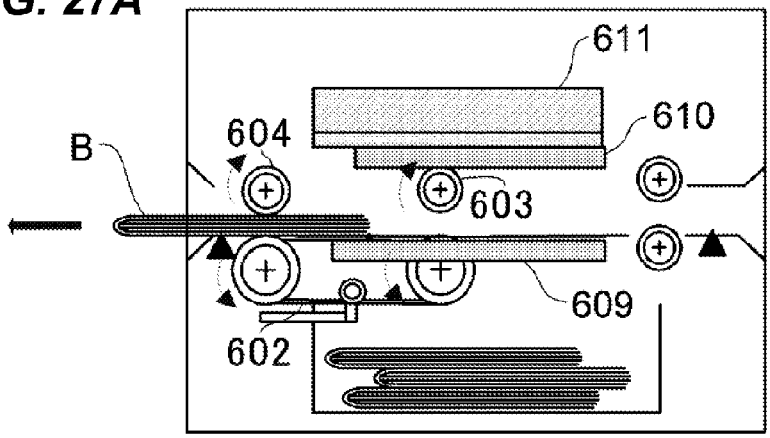
FIG. 27A is a cross-sectional view of the top and tail edges cutting unit which performs the operation of the top and tail edges cutting process.
Figure 27B:
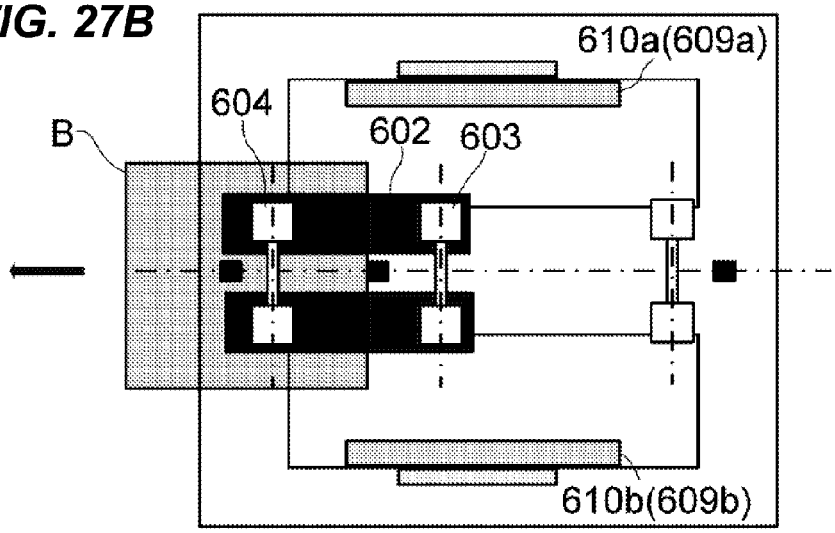
FIG. 27B is a top view of the top and tail edges cutting unit which performs the operation of the top and tail edges cutting process.

As illustrated in FIG. 25, the top and tail edges cutting process is performed by the cutter 611 to cut the top and tail edges of the booklet bundle B. Thereafter, as illustrated in FIG. 26, the upper cutting guide 610 is retracted upward, and the upper cutting guide 610 and the lower cutting guide 609 are retracted in a direction moving away from the booklet bundle B.

The grip of the booklet bundle B which has been subjected to the top and tail edges cutting process is released. As illustrated in FIG. 27, the booklet bundle B is discharged to the outside of the apparatus by moving the belt conveying roller 602, the conveying roller 603, and the discharge conveying roller 604.

(Flattening Processing Unit)

Figure 9A:
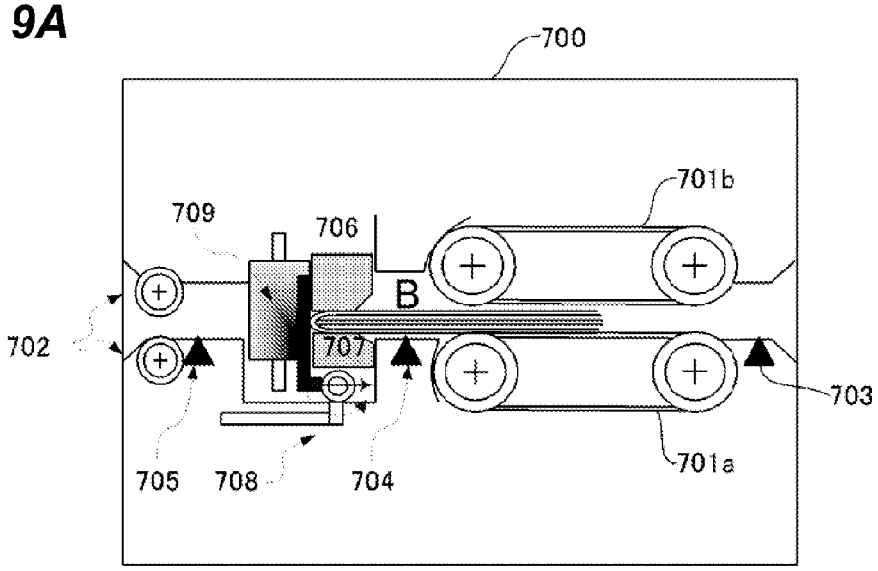
FIG. 9A is a cross-sectional view of a flattening processing unit.
Figure 9B:
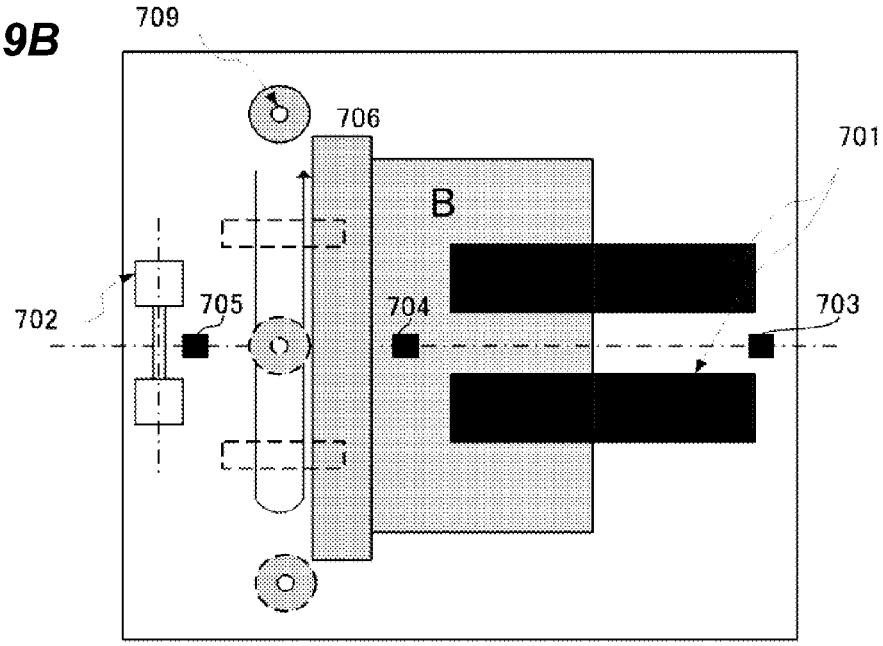
FIG. 9B is a top view of the flattening processing unit.
Figure 10A:
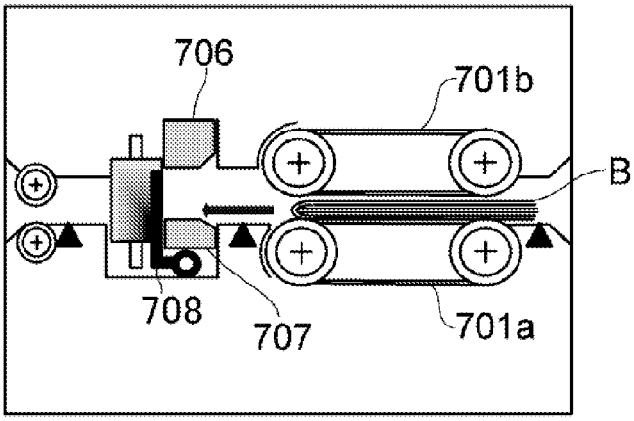
FIG. 10A is a cross-sectional view of the flattening processing unit which performs the operation of the flattening process.
Figure 10B:
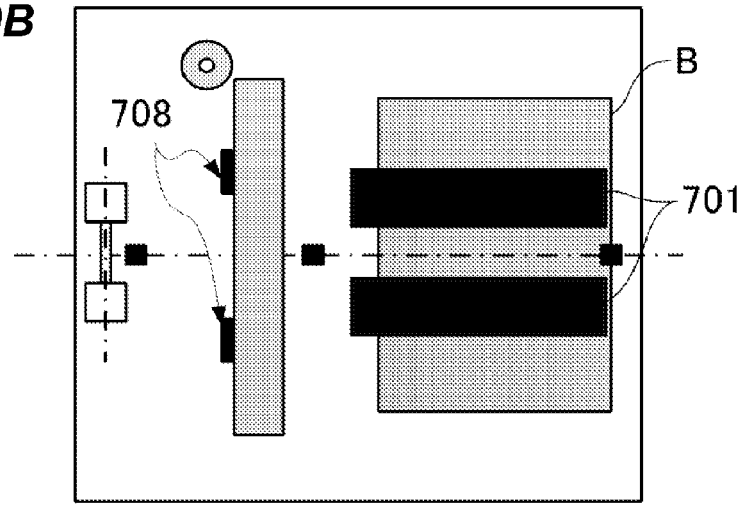
FIG. 10B is a top view of the flattening processing unit which performs the operation of the flattening process.
Figure 11A:
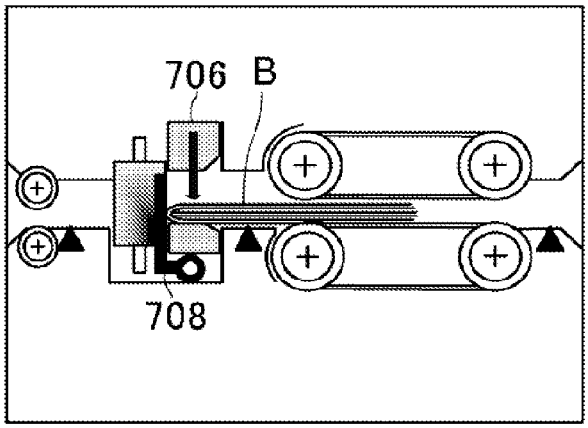
FIG. 11A is a cross-sectional view of the flattening processing unit which performs the operation of the flattening process.
Figure 11B:
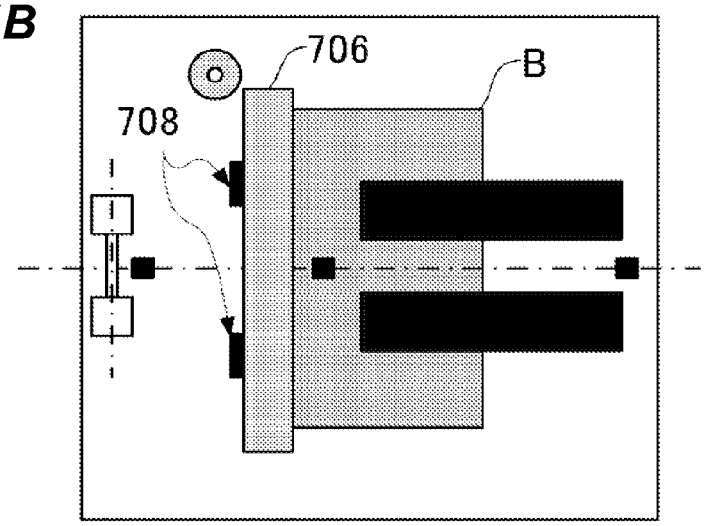
FIG. 11B is a top view of the flattening processing unit which performs the operation of the flattening process.
Figure 12A:
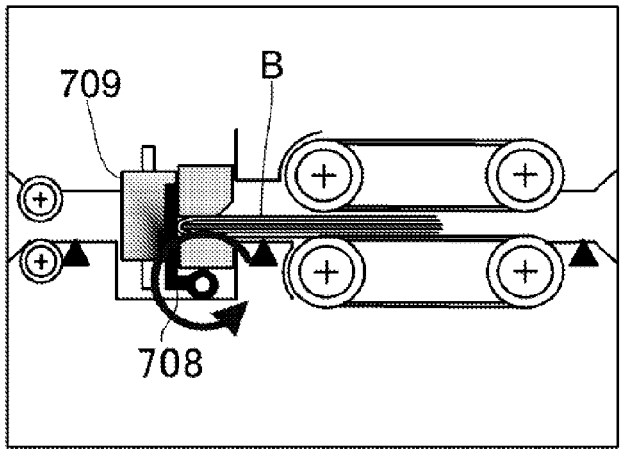
FIG. 12A is a cross-sectional view of the flattening processing unit which performs the operation of the flattening process.
Figure 12B:
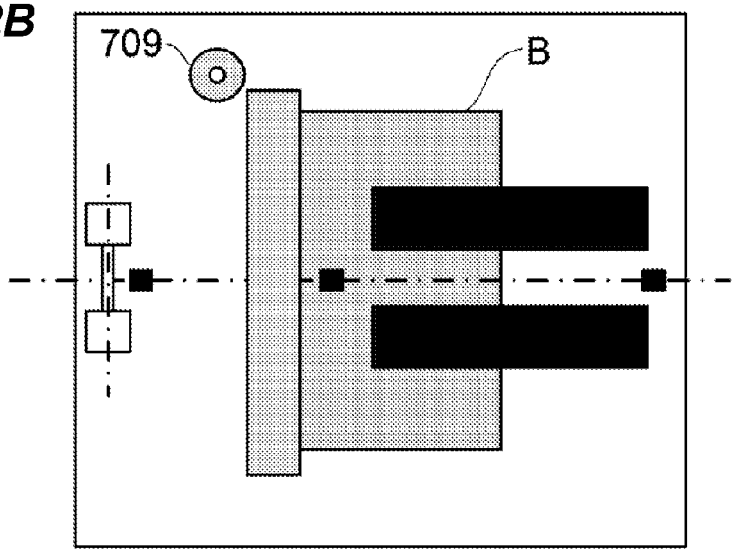
FIG. 12B is a top view of the flattening processing unit which performs the operation of the flattening process.
Figure 13A:
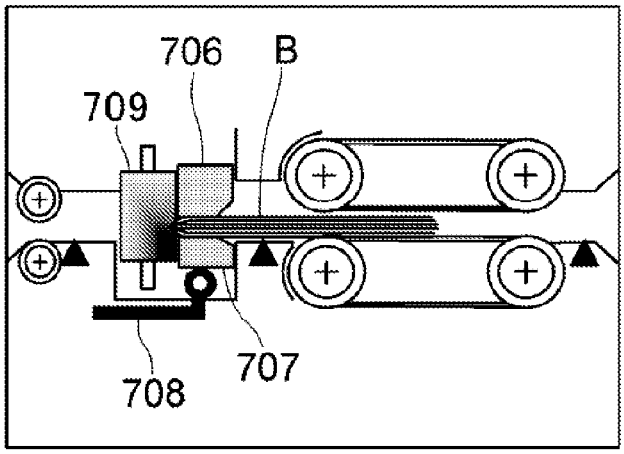
FIG. 13A is a cross-sectional view of the flattening processing unit which performs the operation of the flattening process.
Figure 13B:
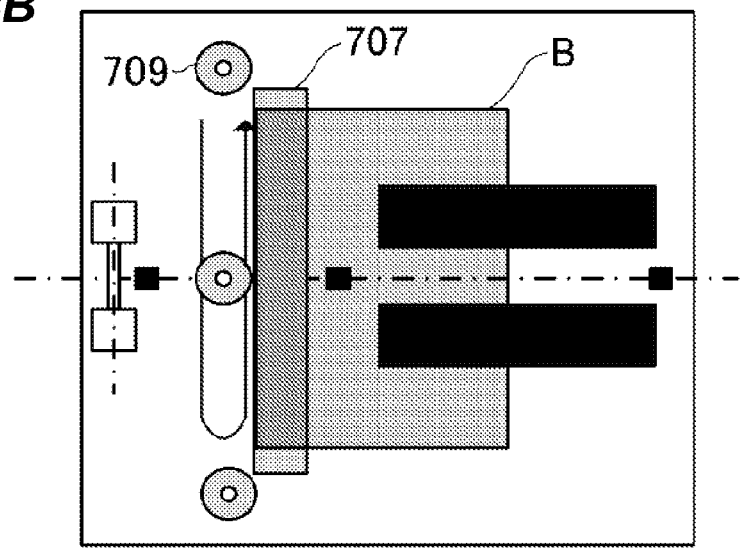
FIG. 13B is a top view of the flattening processing unit which performs the operation of the flattening process.
Figure 14A:
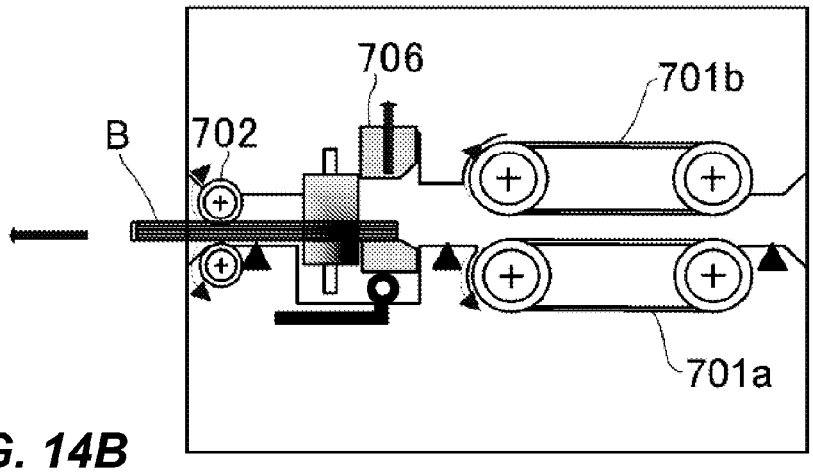
FIG. 14A is a cross-sectional view of the flattening processing unit which performs the operation of the flattening process.
Figure 14B:
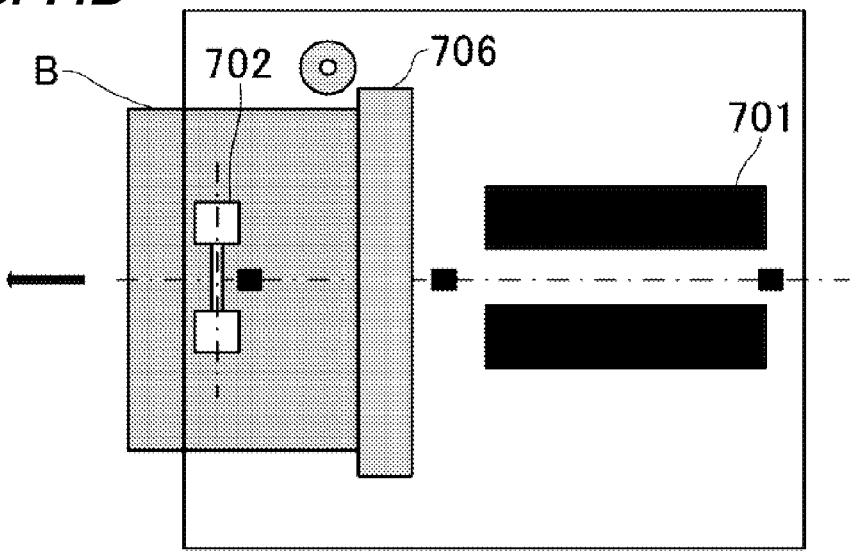
FIG. 14B is a top view of the flattening processing unit which performs the operation of the flattening process.

The configuration of the flattening processing unit 700 will be described with reference to FIG. 9. FIG. 9 is a diagram describing the flattening processing unit 700 of FIG. 1, in which FIG. 9A is a cross-sectional view and FIG. 9B is a top view.

The flattening processing unit 700 is the deforming processing portion which presses a folded end of the folded sheet bundle (hereinafter, called a booklet bundle) B to deform the folded end into a flat shape (a square back shape having corners). When the folded end is deformed into a square back shape, a back of the folded sheet bundle may be a concave shape, not flat.

The flattening processing unit 700 receives the booklet bundle B which has been folded by the bookbinding processing portion of the finisher 500 at the center reference by a belt conveying roller 701. The booklet bundle B which has passed through the top and tail edges cutting unit 600 and has been selectively subjected to the top and tail edges cutting process is received at the center reference.

The belt conveying roller 701 has a lower belt conveying roller 701*a* and an upper belt conveying roller 701*b*. The upper belt conveying roller 701*b* is moved in the up and down directions by a spring (not illustrated) and can receive the booklet bundle whose thickness is changed.

A skew feeding correction stopper 708 which corrects the skew feeding of the received booklet bundle B is provided on the downstream side of the belt conveying roller 701. The skew feeding correction stopper 708 completes the skew feeding correction so as to be rotationally retracted. The skew feeding correction stopper 708 conveys the booklet bundle B to a discharge conveying roller 702.

The booklet bundle B whose skew feeding has been corrected by the skew feeding correction stopper 708 is gripped by a fixed lower gripper 707 and a movable upper gripper 706.

The skew feeding correction stopper 708 is movable in the conveying direction. The grip position of the booklet bundle B in the conveying direction can adjust the amount of protrusion of the folded end of the booklet bundle B from the gripper end faces by adjusting the skew feeding correction position of the skew feeding correction stopper 708.

The folded end of the booklet bundle B fixed by the grippers 706 and 707 is flattened by moving a pressing roller 709, cylindrically-shaped, which performs the flattening process in a direction perpendicular to the conveying direction in the state that the pressing roller 709 presses the folded end of the booklet bundle B protruded from the grippers. The pressing roller 709 may be a crown-shaped, not cylindrically-shaped, thereby the back of the folded sheet bundle may be a concave shape, not flat.

In the conveying path, there are provided an inlet sensor 703 which detects that the booklet bundle B has been conveyed into the flattening processing unit 700, a sensor 704 which detects that the booklet bundle B has reached the skew feeding correction position, and a discharge outlet sensor 705 which detects that the booklet bundle B has been discharged from the flattening processing unit 700.

(Operation of Flattening Process)

The flow of the operation of the flattening process, as a deforming process, will be described. FIGS. 10 to 14 are diagrams describing the operation of the flattening process, in which FIGS. 10A, 11A, 12A, 13A, and 14A are cross-sectional views and FIGS. 10B, 11B, 12B, 13B, and 14B are top views.

As illustrated in FIG. 10, the folded booklet bundle B is conveyed to the belt conveying roller 701 at the center reference. The lower gripper 707 and the upper gripper 706 are opened. The skew feeding correction stopper 708 has already been moved to and on standby in the skew feeding correction position.

As illustrated in FIG. 11, the booklet bundle B is abutted onto the skew feeding correction stopper 708 to correct the skew feeding. The belt conveying roller 701 is stopped. The upper gripper 706 is lowered to fix the booklet bundle B.

As illustrated in FIG. 12, to move the pressing roller 709, the skew feeding correction stopper 708 is retracted. As illustrated in FIG. 13, the folded end of the booklet bundle B is flattened by reciprocating the pressing roller 709 in a direction perpendicular to the conveying direction in the state that the pressing roller 709 presses the folded end of the booklet bundle B protruded from the lower gripper 707 and the upper gripper 706.

As illustrated in FIG. 14, the upper gripper 706 is raised to release the grip of the booklet bundle B. The flattened booklet bundle B is discharged to the outside of the apparatus by moving the belt conveying roller 701 and the discharge conveying roller 702.

(Fore Edge Cutting Unit)

Figure 15A:
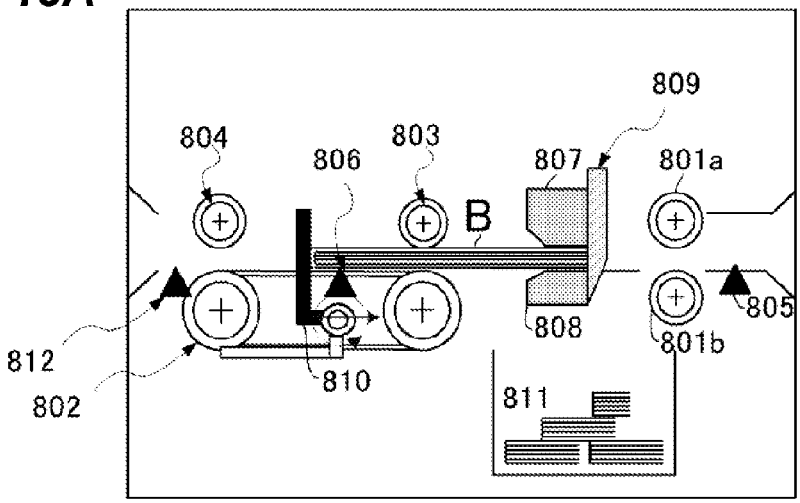
FIG. 15A is a cross-sectional view of a fore edge cutting unit.
Figure 15B:
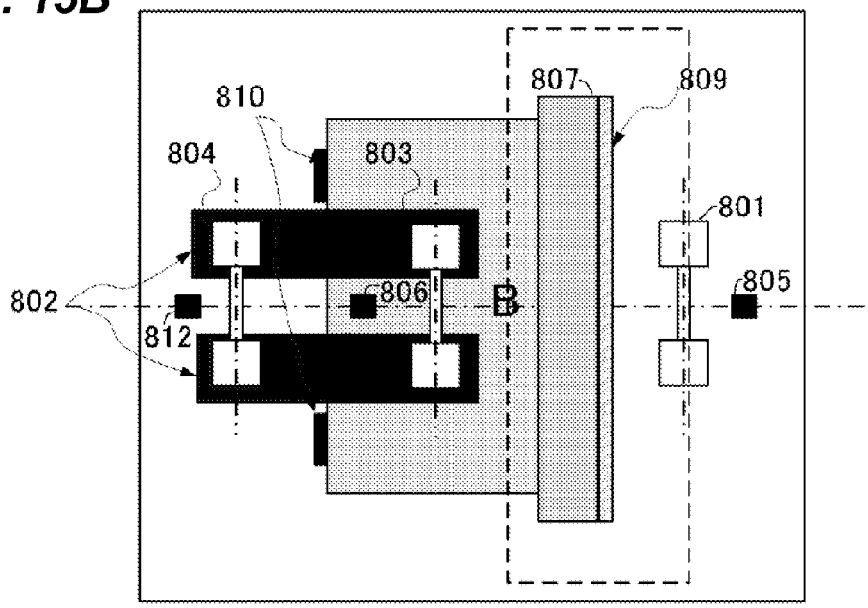
FIG. 15B is a top view of the fore edge cutting unit.
Figure 16A:
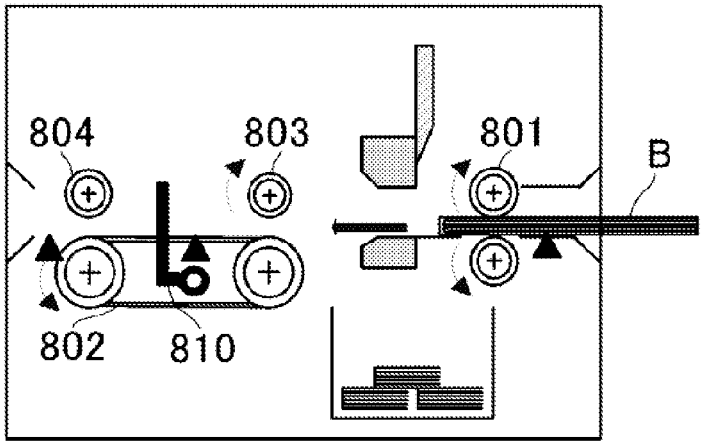
FIG. 16A is a cross-sectional view of the fore edge cutting unit which performs the operation of the fore edge cutting process.
Figure 16B:
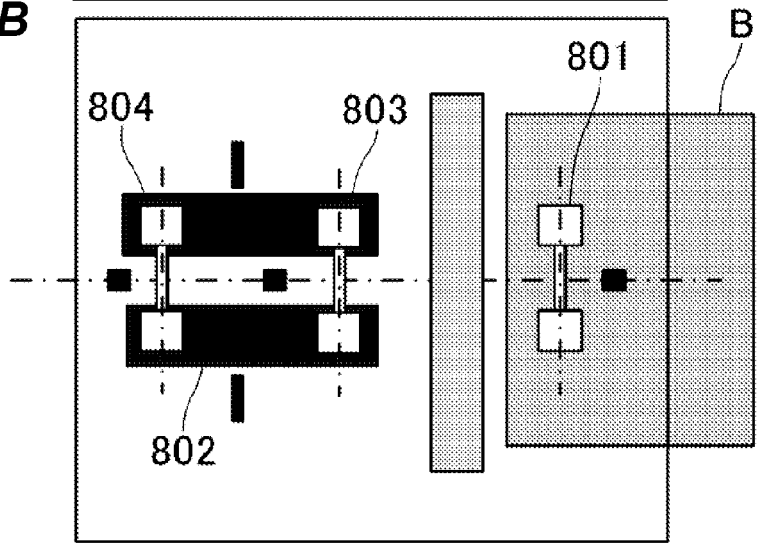
FIG. 16B is a top view of the fore edge cutting unit which performs the operation of the fore edge cutting process.
Figure 17A:
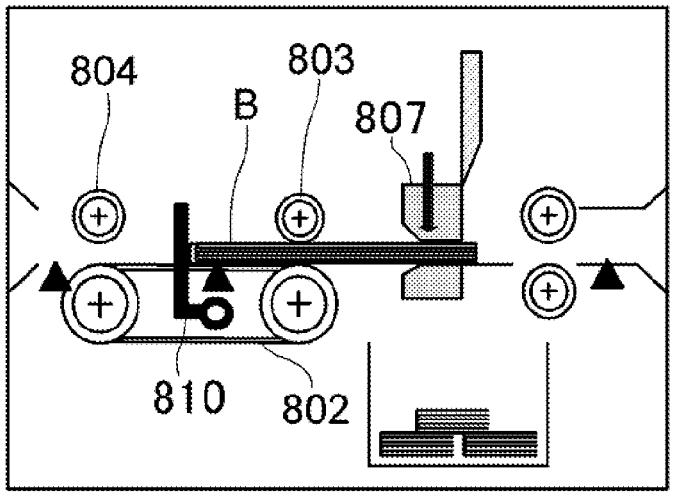
FIG. 17A is a cross-sectional view of the fore edge cutting unit which performs the operation of the fore edge cutting process.
Figure 17B:
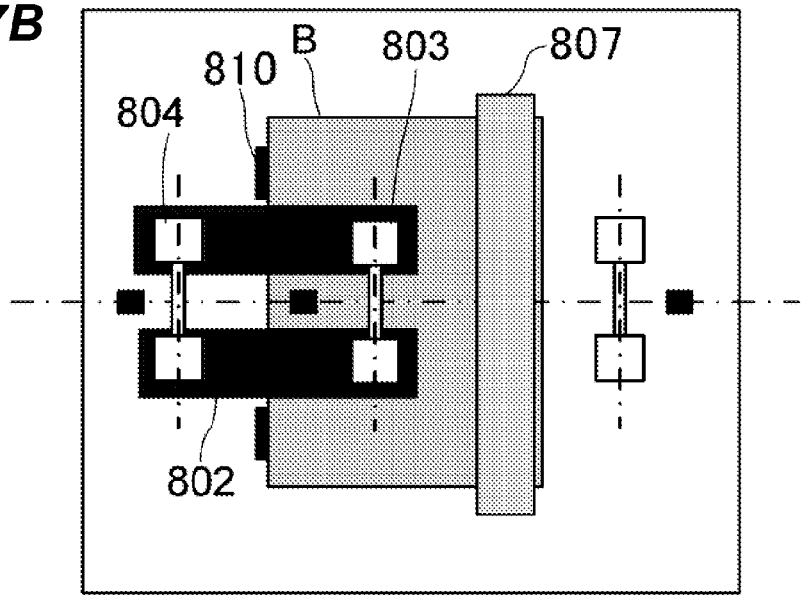
FIG. 17B is a top view of the fore edge cutting unit which performs the operation of the fore edge cutting process.
Figure 18A:
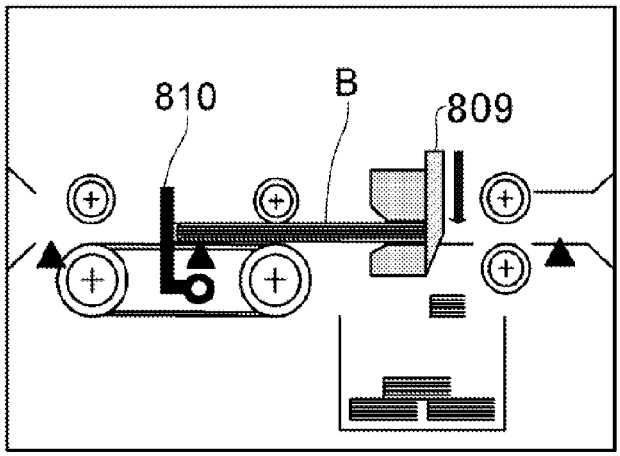
FIG. 18A is a cross-sectional view of the fore edge cutting unit which performs the operation of the fore edge cutting process.
Figure 18B:
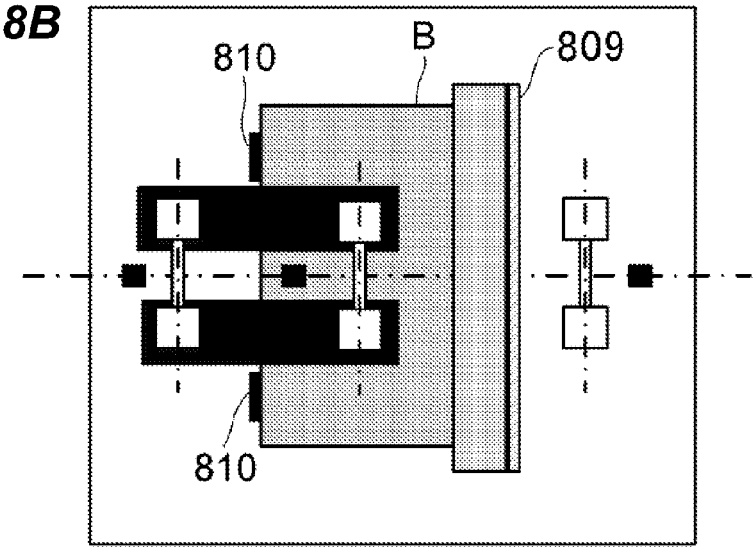
FIG. 18B is a top view of the fore edge cutting unit which performs the operation of the fore edge cutting process.
Figure 19A:
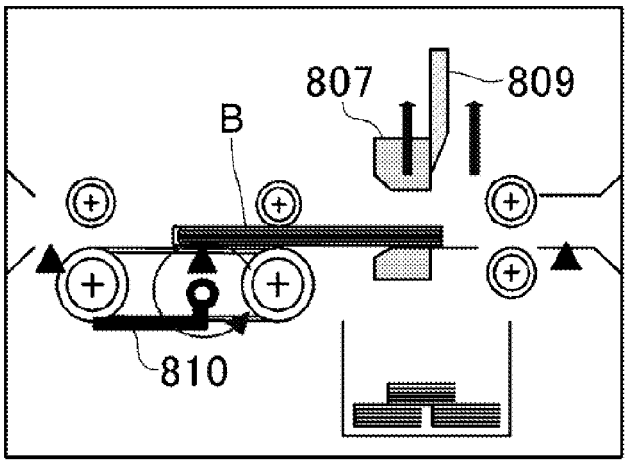
FIG. 19A is a cross-sectional view of the fore edge cutting unit which performs the operation of the fore edge cutting process.
Figure 19B:
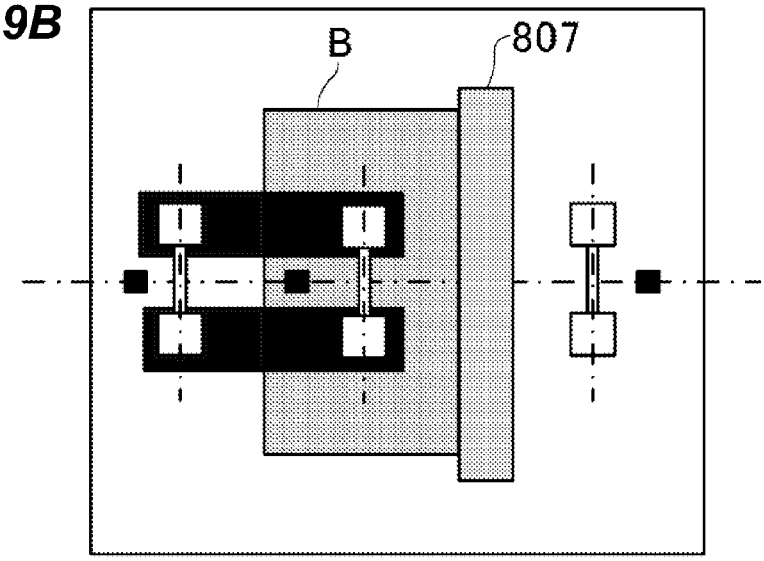
FIG. 19B is a top view of the fore edge cutting unit which performs the operation of the fore edge cutting process.
Figure 20A:
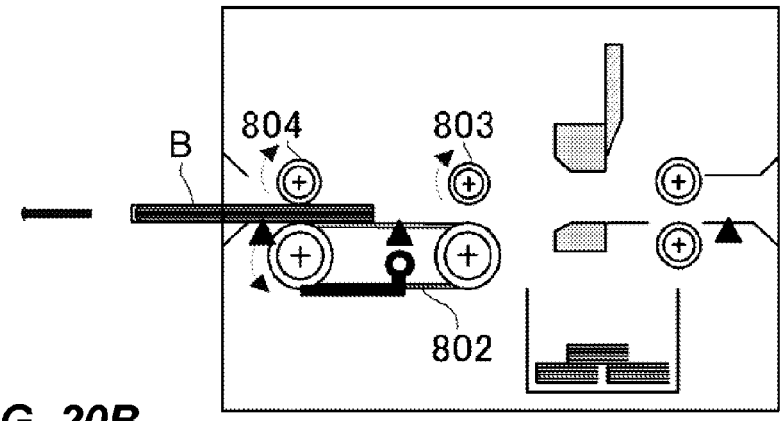
FIG. 20A is a cross-sectional view of the fore edge cutting unit which performs the operation of the fore edge cutting process.
Figure 20B:
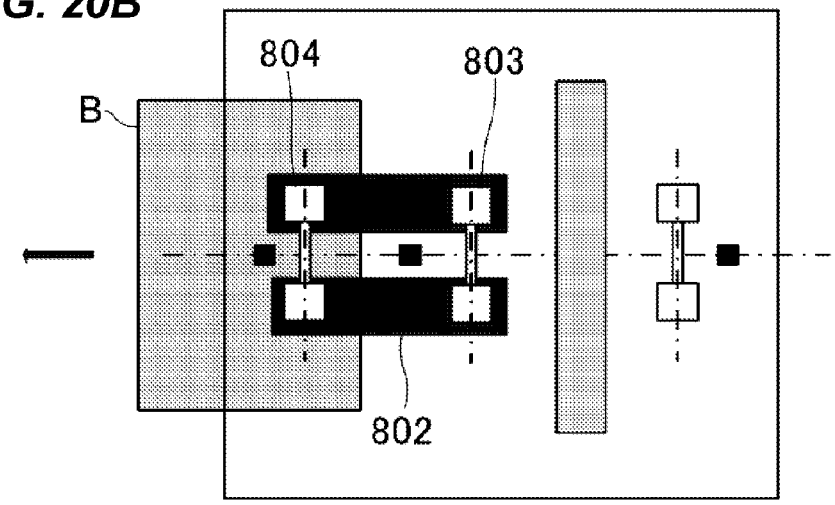
FIG. 20B is a top view of the fore edge cutting unit which performs the operation of the fore edge cutting process.

The configuration of the fore edge cutting unit 800 will be described with reference to FIG. 15. FIG. 15 is a diagram describing the fore edge cutting unit 800 of FIG. 1, in which FIG. 15A is a cross-sectional view and FIG. 15B is a top view.

The fore edge cutting unit 800 is a fore edge cutting processing portion which cuts an edge opposite the folded end of the folded booklet bundle B. The fore edge cutting unit 800 configures the cutting processing portion which cuts and aligns the edge of the booklet bundle B together with the top and tail edges cutting unit 600.

The fore edge cutting unit 800 receives the booklet bundle B which has been folded by the bookbinding processing portion of the finisher 500 at the center reference by an inlet conveying roller 801. The booklet bundle B which has passed through the flattening processing unit 700 and has been selectively subjected to the flattening process is received at the center reference. The present invention is not limited to the configuration. The flattening processing unit 700 may be provided as the deforming processing portion so as to be integrated with the fore edge cutting unit 800.

The inlet conveying roller 801 has an upper conveying roller 801*a* and a lower conveying roller 801*b*. The upper conveying roller 801*a* is moved in the up and down directions by a spring (not illustrated) and can receive the booklet bundle whose thickness is changed.

A belt conveying roller 802, a conveying roller 803, and a discharge conveying roller 804 are arranged on the downstream side of the inlet conveying roller 801. The discharge conveying roller 804 and the conveying roller 803 are moved in the up and down directions by a spring (not illustrated).

A skew feeding correction stopper 810 which corrects the skew feeding of the received booklet bundle B is provided on the downstream side of the conveying roller 803. The skew feeding correction stopper 810 completes the skew feeding correction so as to be rotationally retracted. The skew feeding correction stopper 810 conveys the booklet bundle B to the discharge conveying roller 804.

The booklet bundle whose skew feeding has been corrected by the skew feeding correction stopper 708 is gripped by a fixed lower gripper 808 and a movable upper gripper 807.

The skew feeding correction stopper 810 is movable in the conveying direction. The grip position of the booklet bundle B in the conveying direction can realize the adjustment of the fore edge cutting position of the booklet bundle B by adjusting the skew feeding correction position of the skew feeding correction stopper 810.

The fore edge opposite the folded end of the booklet bundle B fixed by the grippers 808 and 807 is cut by a cutter 809. The cut paper waste is stored in a trash box 811.

In the conveying path, there are provided an inlet sensor 805 which detects that the booklet bundle B has been conveyed into the fore edge cutting unit 800, a sensor 806 which detects that the booklet bundle B has reached the skew feeding correction position, and a discharge outlet sensor 812 which detects that the booklet bundle B has been discharged from the fore edge cutting unit 800.

(Operation of Fore Edge Cutting Process)

The flow of the operation of the fore edge cutting process will be described. FIGS. 16 to 20 are diagrams describing the operation of the fore edge cutting process, in which FIGS. 16A, 17A, 18A, 19A, and 20A are cross-sectional views and FIGS. 16B, 17B, 18B, 19B, and 20B are top views.

As illustrated in FIG. 16, the folded booklet bundle B is conveyed to the inlet conveying roller 801 at the center reference. The booklet bundle B is conveyed to the skew feeding correction stopper 810 by the driving of the belt conveying roller 802 and the conveying roller 803. In this state, the lower gripper 808 and the upper gripper 807 are opened, and the skew feeding correction stopper 810 has already been moved to and on standby in the skew feeding correction position.

As illustrated in FIG. 17, the booklet bundle B is abutted onto the skew feeding correction stopper 810 to correct the skew feeding. Accordingly, the belt conveying roller 802 and the conveying roller 803 are stopped, and the upper gripper 807 is lowered to fix the booklet bundle B.

As illustrated in FIG. 18, the fore edge of the booklet bundle B is cut by the cutter 809. Thereafter, as illustrated in FIG. 19, the skew feeding correction stopper 810 is retracted. The upper gripper 807 is raised to prepare for conveying the booklet bundle B.

The grip of the booklet bundle B which has been subjected to the fore edge cutting process is released. As illustrated in FIG. 20, the booklet bundle B is discharged to the outside of the apparatus by moving the belt conveying roller 802, the conveying roller 803, and the discharge conveying roller 804. The booklet bundle B is discharged to the bookbinding stack tray 11 (see FIG. 1).

(Setting of Bookbinding Mode)

The flow of the setting of the bookbinding mode and the cutting mode will be described with reference to FIGS. 28 to 31.

Figure 29A:
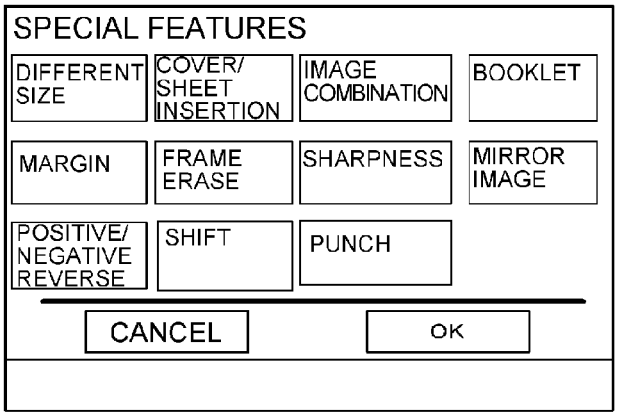
FIGS. 29A, 29B, and 29C are diagrams illustrating the flow of setting of a bookbinding mode.
Figure 29B:
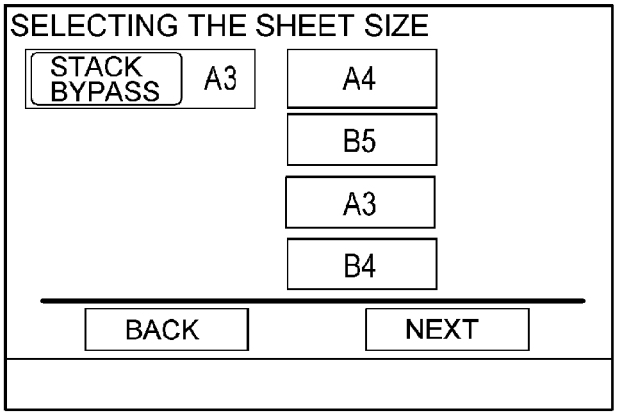

When the "special features" soft-key is selected on the initial screen illustrated in FIG. 28, the operation displaying portion 420 is switched to the screen which selects various modes illustrated in FIG. 29A. When the "bookbinding" soft-key is selected, as illustrated in FIG. 29B, the key which can select the cassette which stores the sheet to be output is displayed. Here, when the cassette which stores the sheet of size to use is selected to depress the "next" soft-key, as illustrated in FIG. 29C, the screen which sets the bookbinding bundle process is displayed.

If the bookbinding mode is selected, at least the folding process is performed. The user can select whether saddle stitch is performed or not. As illustrated in FIG. 29C, the "saddle stitch" or "do not saddle stitch" soft-key is selected. Independently of saddle stitch, the "cut" or "do not cut" soft-key can be selected.

Figure 29C:
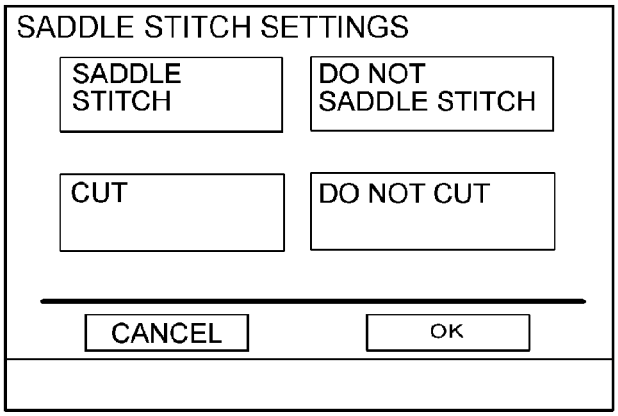
Figure 31:
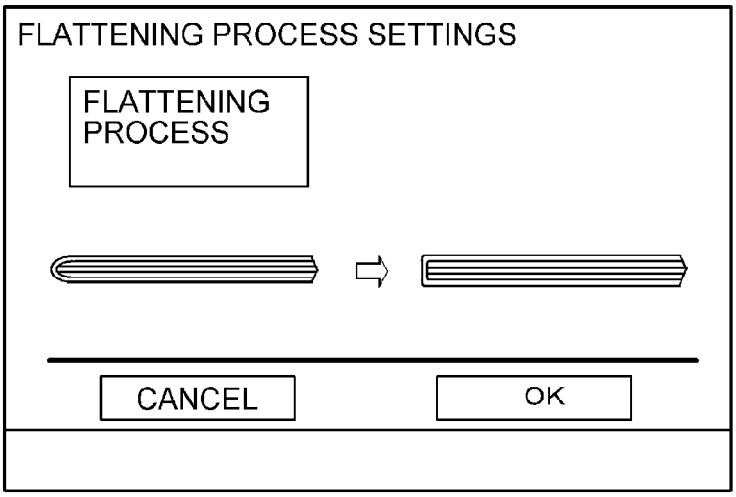
FIG. 31 is a diagram illustrating the flow of setting of the bookbinding mode.

On the screen illustrated in FIG. 29C, the "do not cut" soft-key is selected in the setting of any of the "saddle stitch" and "do not saddle stitch" soft-keys. The "OK" key is pressed to end the setting. The flattening process setting screen illustrated in FIG. 31 is displayed.

Figure 30A:
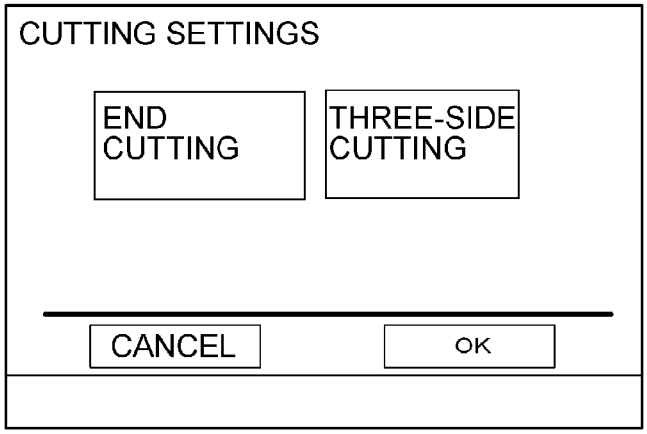
FIGS. 30A, 30B, and 30C are diagrams illustrating the flow of setting of the bookbinding mode.

On the screen illustrated in FIG. 29C, when the "cut" soft-key is selected in the setting of any of the "saddle stitch" and "do not saddle stitch" soft-keys, and the "OK" key is pressed, the screen which sets the cutting process illustrated in FIG. 30A is displayed. Then, the fore edge cutting or the three-side cutting which performs both the fore edge cutting and the top and tail edges cutting is selected.

Figure 30B:
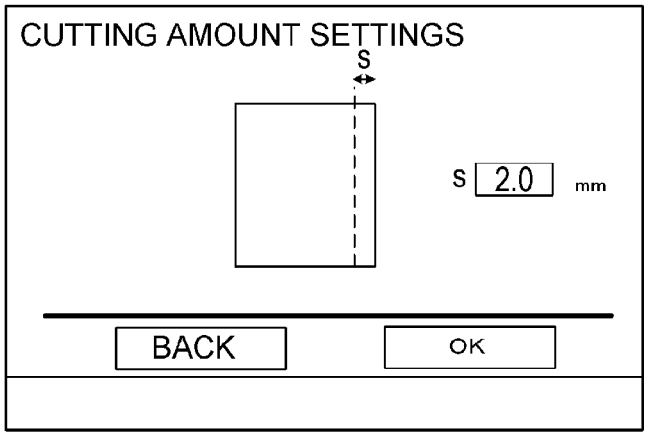

If the fore edge cutting is selected on the screen illustrated in FIG. 30A, as illustrated in FIG. 30B, the screen which sets a length s at which the fore edge of the sheet of the booklet bundle is cut is displayed. Any amount of cutting is set from the numeric key of the operation displaying portion. After the amount of cutting is set, the "OK" key is pressed to end the setting. The flattening process setting screen illustrated in FIG. 31 is displayed.

Figure 30C:
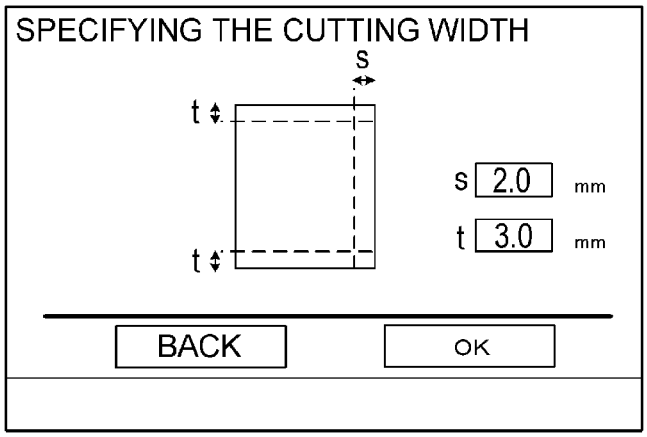

The three-side cutting is selected on the screen illustrated in FIG. 30A. As illustrated in FIG. 30C, the screen which sets the length s at which the fore edge of the sheet of the booklet bundle is cut and a length t at which the top and tail edges of the sheet are cut is displayed. Any amount of cutting is set from the numeric key of the operation displaying portion. After the amount of cutting is set, the "OK" key is pressed to end the setting. The flattening process setting screen illustrated in FIG. 31 is displayed.

The presence or absence of the performance of the flattening process is set on the flattening process setting screen illustrated in FIG. 31. Accordingly, the "OK" key is pressed to end the setting, and the initial screen is returned. The start key 402 is depressed to wait for the start of the operation.

(Operation Combining Flattening Process and Cutting Process in Bookbinding Mode)

Figure 32:
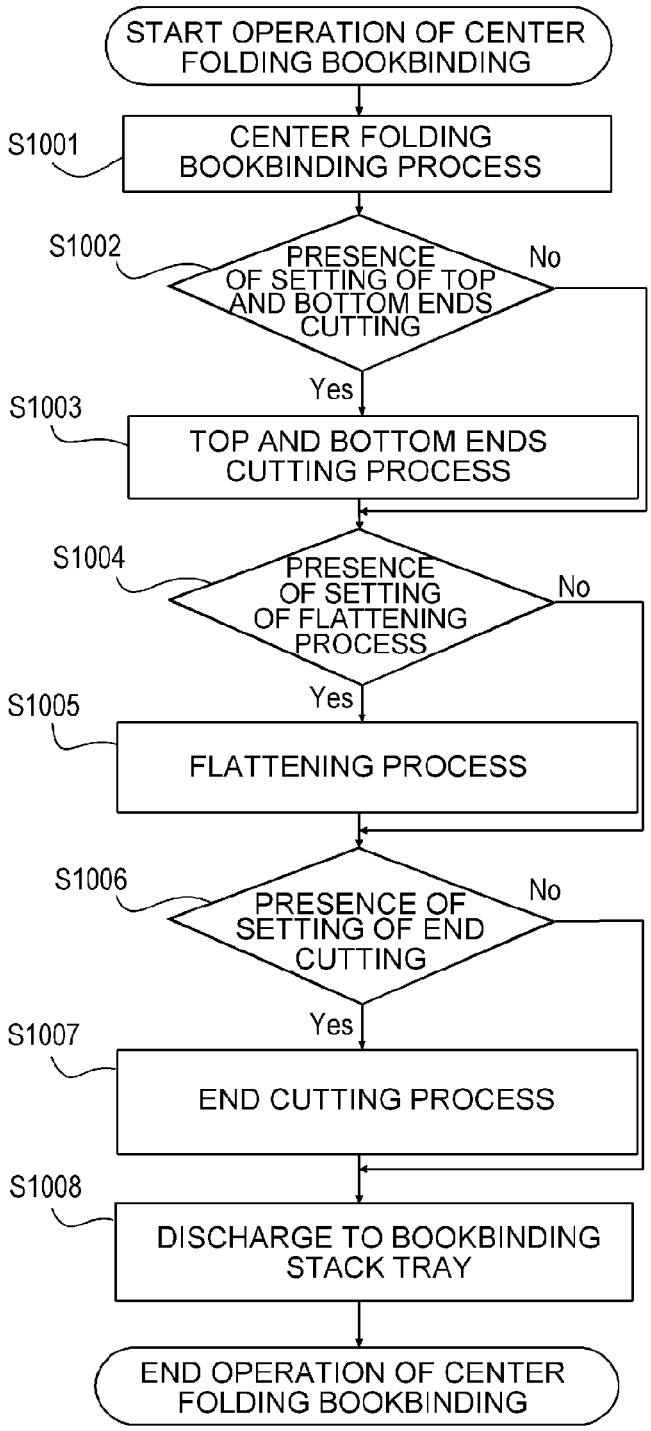
FIG. 32 is a flowchart illustrating the flow of the operation of the bookbinding mode.

The flow of the processing operation combining the flattening process, as a deforming process, and the cutting process which is performed to the folded booklet bundle will be described with reference to FIG. 32.

In this embodiment, when the folded booklet bundle is subjected to the flattening process and the cutting process, the order of the flattening process and the cutting process is changed according to the position of the edges of the booklet bundle cut by the cutting units 600 and 800 so as to improve the quality of the booklet bundle.

The flow of the operation of FIG. 32 will be described. The operation of the folding process is started, and the folding process is then performed by the folding mechanism provided in the finisher 500 in step S1001.

In step S1002, it is determined whether the top and tail edges cutting process is set or not. If the top and tail edges cutting process is set, the process is advanced to step S1003 to perform the top and tail edges cutting process by the top and tail edges cutting unit 600. If the top and tail edges cutting process is not set, the process is advanced to step S1004.

In step S1004, it is determined whether the flattening process is set or not. If the flattening process is set, the process is advanced to step S1005 to perform the flattening process by the flattening processing unit 700. If the flattening process is not set, the process is advanced to step S1006.

In step S1006, it is determined whether the fore edge cutting process is set or not. If the fore edge cutting process is set, the process is advanced to step S1007 to perform the fore edge cutting process by the fore edge cutting unit 800. If the fore edge cutting process is not set, the process is advanced to step S1008 to discharge the folded booklet bundle to the bookbinding stack tray 11. The operation of the bookbinding mode is then ended.

In the operation which subjects the folded booklet bundle to a combination of the flattening process and the cutting process, the flow of the operation when the fore edge cutting is set on the setting screen illustrated in FIG. 31A will be described using FIG. 32. When the fore edge cutting is set, only the fore edge cutting process of the cutting process is set.

When the operation of the folding process is started, the folding process is performed by the folding mechanism provided in the finisher 500 in step S1001.

In step S1002, the top and tail edges cutting process is not set, so that the process is advanced to step S1004.

In step S1004, the flattening process is set, so that the process is advanced to step S1005. The flattening process is performed by the flattening processing unit 700. After the flattening process is performed, the process is advanced to step S1006.

In step S1006, the fore edge cutting process is set, so that the process is advanced to step S1007, and the fore edge cutting process is performed by the fore edge cutting unit 800. After the fore edge cutting process is performed, the process is advanced to step S1008. The folded booklet bundle is discharged to the bookbinding stack tray 11 to end the operation of the bookbinding mode.

When the folded booklet bundle is subjected to the fore edge cutting process and the flattening process, the fore edge cutting process is performed after the flattening process is performed. Consequently, variation in the fore edge cutting surface can be prevented, and the booklet bundle having a high quality can be provided to the user without lowering the quality of the booklet bundle.

In the operation which subjects the folded booklet bundle to a combination of the flattening process and the cutting process, the flow of the operation when the three-side cutting is set on the setting screen illustrated in FIG. 31A will be described using FIG. 32. When the three-side cutting is set, the fore edge cutting process and the top and tail edges cutting process are set.

When the operation of the folding process is started, the folding process is performed by the folding mechanism provided in the finisher 500 in step S1001.

In step S1002, the top and tail edges cutting process is set, so that the process is advanced to step S1003. The top and tail edges cutting process is performed by the top and tail edges cutting unit 600. After the top and tail edges cutting process is performed, the process is advanced to step S1004.

In step S1004, the flattening process is set, so that the process is advanced to step S1005, and the flattening process is performed by the flattening processing unit 700. After the flattening process is performed, the process is advanced to step S1006.

In step S1006, the fore edge cutting process is set, so that the process is advanced to step S1007, and the fore edge cutting process is performed by the fore edge cutting unit 800. After the fore edge cutting process is performed, the process is advanced to step S1008. The folded booklet bundle is discharged to the bookbinding stack tray 11 to end the operation of the bookbinding mode.

When the folded booklet bundle is subjected to the top and tail edges cutting process, the flattening process, and the fore edge cutting process are performed, the top and tail edges cutting process is performed before the flattening process is performed. After the flattening process is performed, the fore edge cutting process is performed. The collapse of the folded end of the flattened booklet bundle can be prevented, and variation in the fore edge cutting surface can be also prevented. The booklet bundle having a high quality can be provided to the user without lowering the quality of the booklet bundle.

As described above, according to this embodiment, the order of the flattening process and the cutting process is changed according to the position of the edges of the booklet bundle cut by the cutting units 600 and 800 to improve the quality of the booklet bundle. Accordingly, even if the booklet bundle is subjected to a combination of the flattening process and the cutting process, the quality of the booklet bundle can be improved without lowering the quality of the booklet bundle.

In the above embodiment, the fore edge cutting or the three-side cutting can be selected on the setting screen illustrated in FIG. 31A. The present invention is not limited to this. The top and tail edges cutting in which only the top and tail edges cutting process of the cutting process is set may be selected on the setting screen illustrated in FIG. 31A. If the folded booklet bundle is subjected to the top and tail edges cutting process and the flattening process, the flattening process is performed after the top and tail edges cutting process is performed. Consequently, the collapse of the folded end of the flattened booklet bundle can be prevented, and the booklet bundle having a high quality can be provided to the user without lowering the quality of the booklet bundle.

In the above embodiment, there is illustrated the sheet processing apparatus in which discrete units which are the top and tail edges cutting unit 600, the flattening processing unit 700, and the fore edge cutting unit 800 configure a system. One sheet processing apparatus may have a plurality of processing functions.

In the above embodiment, there is illustrated the configuration which has the cutting processing portion of both the top and tail edges cutting unit 600 and the fore edge cutting unit 800. The sheet processing apparatus may have the cutting processing portion of either of the top and tail edges cutting unit 600 and the fore edge cutting unit 800.

In the above embodiment, the present invention is applied to the sheet processing apparatus in the image forming system. The present invention is not limited to this. The present invention is applied to the image forming apparatus which has the image forming portion, the folding processing portion, the deforming processing portion, and the cutting processing portion, and the same effect can be obtained.

In the above embodiment, the cutting processing portion is divided into the top and tail edges cutting unit 600 and the fore edge cutting unit 800. The top and tail edges cutting unit 600 and the fore edge cutting unit 800 are arranged on the upstream and downstream sides of the flattening processing unit 700 in the conveying direction. The present invention is not limited to this. The cutting processing unit which integrates the top and tail edges cutting portion and the fore edge cutting portion is provided on either of the upstream and downstream sides of the flattening processing unit in the conveying direction. The booklet bundle may be switchback conveyed according to the position of the edge of the booklet bundle cut. The order of the cutting process and the deforming process may be changed. Further, in the cutting processing unit, the cutting portion which cuts the edges of the booklet bundle may be provided at the edges of the booklet bundle perpendicular to each other or may be provided at one of the edges of the booklet bundle to rotate the booklet bundle using a turntable according to the position of the edge of the booklet bundle cut.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-316917, filed Dec. 7, 2007, No. 2008-307060, filed Dec. 2, 2008 which are hereby incorporated by reference herein in their entirety.

The invention claimed is:

1. A sheet processing apparatus comprising:

a folding processing portion which folds a bundle of a plurality of sheets in two;

a cutting processing portion which cuts an edge of the folded bundle folded by the folding processing portion;

a deforming processing portion which presses a folded end of the folded bundle to deform the folded end; and a conveying portion which conveys the folded bundle, wherein after edges crossing the folded end of the folded bundle are cut by the cutting processing portion, the folded end of the folded bundle, conveyed from the cutting processing portion, is deformed by the deforming processing portion, and an edge opposite the folded end of the folded bundle is then cut.

2. The sheet processing apparatus according to claim 1, wherein the cutting processing portion has a fore edge cutting processing portion which cuts a fore edge opposite the folded end of the folded bundle, and a top and tail edges cutting processing portion which cuts top and tail edges crossing the folded end of the folded bundle.

3. The sheet processing apparatus according to claim 2, wherein a top and tail edges cutting process is performed by the top and tail edges cutting processing portion before the deforming process is performed by the deforming processing portion, and a fore edge cutting process is performed by the fore edge cutting processing portion after the deforming process is performed by the deforming processing portion.

4. An image forming apparatus comprising:

an image forming portion which forms an image on a sheet; and a sheet processing apparatus which processes the sheet having the image formed by the image forming portion, wherein the sheet processing apparatus includes:

a folding processing portion which folds a bundle of a plurality of image-formed sheets in two;

a cutting processing portion which cuts an edge of the folded bundle folded by the folding processing portion;

a deforming processing portion which presses a folded end of the folded bundle to deform the folded end; and a conveying portion which conveys the folded bundle, wherein after edges crossing the folded end of the folded bundle are cut by the cutting processing portion, the folded end of the folded bundle, conveyed from the cutting processing portion, is deformed by the deforming processing portion, and an edge opposite the folded end of the folded bundle is then cut.

5. The image forming apparatus according to claim 4, wherein the cutting processing portion has a fore edge cutting processing portion which cuts a fore edge opposite the folded end of the folded bundle, and a top and tail edges cutting processing portion which cuts top and tail edges crossing the folded end of the folded bundle.

6. The image forming apparatus according to claim 5, wherein a top and tail edges cutting process is performed by the top and tail edges cutting processing portion before the deforming process is performed by the deforming processing portion, and a fore edge cutting process is performed by the fore edge cutting processing portion after the deforming process is performed by the deforming processing portion.

7. An image forming system comprising:

an image forming apparatus body which has an image forming portion which forms an image on a sheet;

a folding processing portion which folds a bundle of a plurality of sheets output from the image forming apparatus body in two;

a cutting processing portion which cuts an edge of the folded bundle folded by the folding processing portion;

a deforming processing portion which presses a folded end of the folded bundle to deform the folded end; and a conveying portion which conveys the folded bundle, wherein after edges crossing the folded end of the folded bundle are cut by the cutting processing portion, the folded end of the folded bundle, conveyed from the cutting processing portion, is deformed by the deforming processing portion, and the edge opposite the folded end of the folded bundle is then cut.

8. The image forming system according to claim 7, wherein the cutting processing portion has a fore edge cutting processing portion which cuts a fore edge opposite the folded end of the folded bundle, and a top and tail edges cutting processing portion which cuts top and tail edges crossing the folded end of the folded bundle.

9. The image forming system according to claim 8, wherein a top and tail edges cutting process is performed by the top and tail edges cutting processing portion before the deforming process is performed by the deforming processing portion, and a fore edge cutting process is performed by the fore edge cutting processing portion after the deforming process is performed by the deforming processing portion.

* * * * *